US009988971B2

(12) United States Patent
Yamazaki et al.

(10) Patent No.: US 9,988,971 B2
(45) Date of Patent: Jun. 5, 2018

(54) AIR LEADING TYPE TWO-STROKE ENGINE AND INTAKE SYSTEM FOR SAME, AND CARBURETOR

(71) Applicant: Yamabiko Corporation, Tokyo (JP)

(72) Inventors: Takahiro Yamazaki, Tokyo (JP); Hidekazu Tsunoda, Tokyo (JP); Hisato Osawa, Tokyo (JP); Tomoyoshi Kudo, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 219 days.

(21) Appl. No.: 14/961,910

(22) Filed: Dec. 8, 2015

(65) Prior Publication Data

US 2016/0169087 A1 Jun. 16, 2016

(30) Foreign Application Priority Data

Dec. 10, 2014 (JP) ..... 2014-249905

(51) Int. Cl.
*F02B 25/00* (2006.01)
*F02B 25/20* (2006.01)
(Continued)

(52) U.S. Cl.
CPC ..... *F02B 25/20* (2013.01); *F02B 25/02* (2013.01); *F02B 25/14* (2013.01); *F02B 75/02* (2013.01);
(Continued)

(58) Field of Classification Search
CPC ..... F02B 25/20; F02B 75/02; F02B 25/02; F02B 2075/025; F02B 25/14;
(Continued)

(56) References Cited

U.S. PATENT DOCUMENTS 6,085,703 A 7/2000 Noguchi
6,289,856 B1 9/2001 Noguchi
(Continued)

FOREIGN PATENT DOCUMENTS

DE 102009007344 A1 8/2009
EP 1134380 A2 9/2001
(Continued)

OTHER PUBLICATIONS

Office Action issued in corresponding European Patent Application No. 15 199 339.1 dated Feb. 3, 2017 (5 pages).
(Continued)

*Primary Examiner* — Syed O Hasan
(74) *Attorney, Agent, or Firm* — Kilyk & Bowersox, P.L.L.C.

(57) ABSTRACT

An amount of air taken into an air leading type two-stroke engine is increased to enhance an engine output, and gas emission characteristic deterioration caused by blow-back is inhibited. An inhibition member 16 is disposed between a choke valve 4 in a full open position and a throttle valve 6 in a full open position. The inhibition member 16 includes, for example, a mesh member like a metal mesh. Mixed fuel containing oil is supplied to the air-fuel mixture channel 14. Numerous pores of the inhibition member 16 (mesh member) are occluded by a membrane of oil components of the mixed fuel. Consequently, entry of a blow-back flow of an air-fuel mixture from the air-fuel mixture channel 14 into the air channel 12 through the numerous pores of the flow inhibition member 16 (mesh member) can be inhibited.

4 Claims, 44 Drawing Sheets

(51) Int. Cl.

| | |
|---|---|
| ***F02B 25/14*** | (2006.01) |
| ***F02M 1/02*** | (2006.01) |
| ***F02M 17/02*** | (2006.01) |
| ***F02B 25/02*** | (2006.01) |
| ***F02B 75/02*** | (2006.01) |
| ***F02M 19/06*** | (2006.01) |
| ***F02M 35/10*** | (2006.01) |

(52) U.S. Cl.
CPC ..... *F02M 1/02* (2013.01); *F02M 17/02* (2013.01); *F02M 19/06* (2013.01); *F02M 35/10275* (2013.01); *F02B 2075/025* (2013.01)

(58) Field of Classification Search
CPC .... F02M 35/10275; F02M 19/06; F02M 7/06; F02M 1/02; F02M 17/02
USPC ..... 123/73 A, 65 R
See application file for complete search history.

(56) References Cited

U.S. PATENT DOCUMENTS

| | | | |
|---|---|---|---|
| 6,352,058 | B1 | 3/2002 | Yuasa et al. |
| 6,354,251 | B1 | 3/2002 | Toda |
| 6,857,402 | B2 | 2/2005 | Schlossarczyk et al. |
| 6,962,132 | B2 | 11/2005 | Hoche et al. |
| 7,096,834 | B2 | 8/2006 | Yuasa et al. |
| 7,261,281 | B2 | 8/2007 | Raffenberg |
| 7,494,113 | B2 | 2/2009 | Eberhardt et al. |
| 7,513,225 | B2 | 4/2009 | Geyer et al. |
| 2008/0120951 | A1 | 5/2008 | Sato et al. |
| 2009/0283079 | A1 | 11/2009 | Tsunoda |
| 2012/0152218 | A1* | 6/2012 | Grether ..... F02M 13/04 123/73 R |
| 2013/0091816 | A1* | 4/2013 | Yamazaki ..... F02M 35/1019 55/385.1 |
| 2014/0000537 | A1 | 1/2014 | Rieber et al. |

FOREIGN PATENT DOCUMENTS

| | | | |
|---|---|---|---|
| JP | H11-009051 | A | 1/1999 |
| JP | 2004-092558 | A | 3/2004 |
| WO | 2012001731 | A1 | 1/2012 |

OTHER PUBLICATIONS

Extended European Search Report issued in corresponding European Patent Application No. 15199339.1 dated May 18, 2016 (7 pages).

* cited by examiner

AIR LEADING TYPE TWO-STROKE ENGINE AND INTAKE SYSTEM FOR SAME, AND CARBURETOR

BACKGROUND OF THE INVENTION

The present application claims priority from Japanese Patent Application No. 2014-249905, filed Dec. 10, 2014, which is incorporated herein by reference.

The present invention relates to an air leading type two-stroke engine and an intake system for the same, and a carburetor.

Two-stroke engines are used as portable working machines such as brush cutters, chain saws and power blowers (JP Patent Laid-Open No. 11-9051). As well-known, two-stroke engines are supplied with mixed fuel including gasoline containing oil. In this type of two-stroke engine, an intake system includes a carburetor. As carburetors, those using a butterfly valve and those using a rotary valve (U.S. Pat. No. 7,261,281 B2) are known. Carburetors including a rotary valve are called "rotary type carburetors".

In development of two-stroke engines, efforts for compliance with environmental regulations have been made. Typical examples of such engines are air leading type two-stroke engines (U.S. Pat. No. 6,962,132 B2 and International Publication No. WO 98/57053).

In an air leading type two-stroke engine, at an initial stage of a scavenging process, air is induced to a combustion chamber, and subsequently, an air-fuel mixture in a crankcase is induced to the combustion chamber. This type of engine includes a scavenging channel that communicates with each of a combustion chamber and a crankcase. Air is charged to the scavenging channel from an upper portion thereof. In an air leading type two-stroke engine, at an initial stage of a scavenging process, air accumulated in the scavenging channel is induced to the combustion chamber. Scavenging is performed using the air, providing the advantage of being able to reduce HC components in gas emissions.

U.S. Pat. No. 6,962,132 B2 discloses a fundamental configuration of an intake system in an air leading type two-stroke engine. Here, as can be understood from FIG. 1 in U.S. Pat. No. 6,962,132 B2, an intake system in an air leading type two-stroke engine means a route from a filter element of an air cleaner to an engine body.

A fundamental configuration of the intake system in the air leading type two-stroke engine includes two passages. One of the passages is an air passage that allows air to be supplied to a scavenging channel in the engine. The other passage is an air-fuel mixture passage that allows mixed fuel containing oil to be supplied to the engine.

U.S. Pat. No. 6,962,132 B2 discloses an intake system including a throttle valve in a two-stroke engine. Upon the throttle valve being brought to a full-open position, in the engine of U.S. Pat. No. 6,962,132 B2, the air passage from the filter element to the engine body and the air-fuel mixture passage from the filter element to the engine body become independent individually.

As air leading type engines, a piston valve type engine that uses a piston in order to control air to be supplied to a scavenging channel (International Publication No. WO 98/57053 and U.S. Pat. No. 7,513,225 B2, U.S. Pat. No. 6,857,402 B2) and a lead valve type engine that uses a lead valve in order to control air to be supplied to a scavenging channel (JP Patent Laid-Open No. 10-121973) are well-known. Here, U.S. Pat. No. 7,513,225 B2 discloses an intake adapter interposed between a carburetor and an engine body.

The intake adapter includes an air channel and an air-fuel mixture channel. The air channel and the air-fuel mixture channel are formed by dividing an internal passage of the intake adapter by means of a partition wall.

U.S. Pat. No. 7,494,113 B2 discloses a carburetor to be employed in an air leading type two-stroke engine. The carburetor includes a throttle valve, a choke valve and a partition member positioned between these valves. Each of the throttle valve and the choke valve is comprised of a butterfly valve. U.S. Pat. No. 7,494,113 B2 proposes a carburetor using the aforementioned partition wall, the carburetor enabling easy assembling of the carburetor.

FIG. 4 in U.S. Pat. No. 7,494,113 B2 discloses a carburetor including two half partition members positioned oppositely to each other. The two half partition members are spaced from each other at a center area of a gas passage in the carburetor. An opening formed by the opposite ends of the two half partition members, substantially provide a communication portion that brings the air passage and the air-fuel mixture passage into communication with each other in the intake system in the air leading type engine.

FIGS. 63 to 65 attached here are schematic diagrams of the carburetor disclosed in FIG. 4 in U.S. Pat. No. 7,494,113 B2. In FIGS. 63 to 65, reference numeral 400 denotes a gas passage in the carburetor. In the gas passage 400, a choke valve 402 and a throttle valve 404 are disposed. The throttle valve 404 is positioned on the downstream side of the choke valve 402. Reference numeral 406 denotes a rotation shaft of the choke valve 402, and reference numeral 408 denotes a rotation shaft of the throttle valve 404.

Between the choke valve 402 and the throttle valve 404, two half partition members 410 are disposed. Each half partition member 410 is comprised of a flat plate. The opposite ends of the two half partition members 410 form an opening 412 at a center area of the gas passage 400 in the carburetor. The opening 412 substantially provides the "communication portion" that brings the air passage and the air-fuel mixture passage in the air leading type engine.

FIGS. 63 to 65 illustrate the choke valve 402 in a full open position and the throttle valve 404 in a full open position. Between the choke valve 402 and the throttle valve 404, the half partition members 410 are positioned. The flat plate-like half partition members 410 partition a part of the opening 412 between the choke valve 402 in the full open position and the throttle valve 404 in the full open position. Consequently, the half partition members 410 form two channels 414 and 416 (FIG. 64) in the gas passage 400, jointly with the choke valve 402 and the throttle valve 404, which are both in the fully-open positions.

The first channel 414 is an air channel through which air passes, and provides a part of an "air passage" in the intake system of the air leading type engine. The second channel 416 is an air-fuel mixture channel for producing an air-fuel mixture, and provides a part of an "air-fuel mixture passage" in the intake system of the air leading type engine.

Air to be supplied to the scavenging channel of the two-stroke engine through the "air passage" including the air channel 414 is charged into the scavenging channel. The air-fuel mixture produced in the air-fuel mixture channel 416 providing a part of the "air-fuel mixture passage" is induced to the crankcase of the two-stroke engine. The air-fuel mixture induced in the crankcase is compressed by the piston that is descending.

In the air leading type two-stroke engine, air accumulated in the scavenging channel at an initial stage of the scavenging process is induced into the combustion chamber and scavenging is performed by means of the air, enabling reduction of blow-by of the air-fuel mixture. As a result, HC in gas emissions can be reduced. This is a basic advantage of air leading type engines.

In an air leading type two-stroke engine, by means of respective negative pressures generated in a crankcase and a scavenging channel in the course of a piston ascending, the air-fuel mixture is charged into the crankcase and air is charged into the scavenging channel. Comparing the negative pressure exerted in the air channel 414 through the scavenging channel and the negative pressure exerted in the air-fuel mixture channel 416 through the crankcase, the negative pressure in the air-fuel mixture channel 416 is larger. In other words, the air-fuel mixture channel 416 is directly connected to the crankcase. The air channel 414 communicates with the crankcase via the scavenging channel. The negative pressure exerted in the air-fuel mixture channel 416 is directly connected to the crankcase, which is a negative pressure source, and thus, is larger and is exerted earlier than the negative pressure exerted in the air channel 414.

The relatively-large negative pressure exerted in the air-fuel mixture channel 416 draws air from the air channel 414 into the air-fuel mixture channel 416 through the opening 412 (FIG. 64). In other words, a part of the air passing through the "air passage", that is, the air channel 414 enters the "air-fuel mixture passage", that is, the air-fuel mixture channel 416 through the opening 412. Using this phenomenon, an engine intake quantity charged into the crankcase can be increased. This means that an engine output can be enhanced.

The relatively-large opening 412 between the two half partition members 410 positioned oppositely to each other provides a "communication portion" that brings the "air passage" and the "air-fuel mixture passage" into communication with each other in the intake system of the air leading type engine. The communication portion has the advantage as stated above. However, the existence of the communication portion has the drawback of the air-fuel mixture entering the air passage as a result of blow-back. A blow-back flow is a flow from an engine body to an air cleaner in the intake system. In other words, where a gas flow from an air cleaner to an engine body is referred to as a "forward direction", a blow-back flow is a flow in a "reverse" direction.

Note that the terms "upstream" and "downstream" used in the present specification means upstream and downstream in a direction of a flow of gas flowing from an air cleaner to an engine body, that is, the "forward direction", respectively.

Where a speed and amount of a first blow-back flow generated in the "air passage" in the intake system and a speed and amount of a second blow-back flow generated in the "air-fuel mixture passage" are compared, the speed and amount of the second blow-back flow in the air-fuel mixture passage leading to the crankcase having a relatively-large volume are larger. Therefore, as a result of blow-back, the air-fuel mixture in the air-fuel mixture passage enters the air passage through the communication portion. This means that the air in the air passage is contaminated. This problem hinders the aforementioned basic advantage of air leading type engines.

An object of the present invention is to provide an air leading type two-stroke engine that induces air charged in a scavenging channel of an engine body into a combustion chamber and subsequently an air-fuel mixture inside a crankcase to the combustion chamber through the scavenging channel, the two-stroke engine being capable of increasing an engine intake quantity and an engine output is thereby enhanced, and inhibiting gas emission characteristic deterioration due to blow-back, an intake system for the same and a carburetor.

SUMMARY OF THE INVENTION

According to the present invention, basically, the aforementioned technical problems can be solved by provision of an air leading type two-stroke engine that, at an initial stage of a scavenging process of the engine, induces air charged in a scavenging channel of an engine body into a combustion chamber thereof and then induces an air-fuel mixture inside a crankcase of the engine body into the combustion chamber through the scavenging channel, the two-stroke engine including:

a first passage extending from a filter element of an air cleaner to the engine body and allowing air to be supplied to the scavenging channel;

a second passage extending from the filter element to the engine body and allowing at least air to be supplied to the crankcase;

a communication portion that brings the first passage and the second passage into communication with each other; and an inhibition member that inhibits entry of a blow-back of the air-fuel mixture passing in the second passage into the first passage through the communication portion.

The present invention is applicable to a two-stroke engine including a fuel injection valve, which is disclosed in U.S. Application Publication No. 2014/0000537A1. The engine in U.S. Application Publication No. 2014/0000537A1 is not an air leading type engine, but includes a fuel injection valve placed facing a crankcase. Air is supplied to the crankcase through an intake system and an air-fuel mixture is produced in the crankcase.

In the fuel injection valve type two-stroke engine disclosed in U.S. Application Publication No. 2014/0000537A1, air is supplied to a scavenging channel formed in an engine body through an air passage that is different from a passage for supplying air to the crankcase, enabling designing of an air leading type engine. The present invention is applicable also to this fuel injection valve type engine.

In order to make a fuel injection valve type two-stroke engine be included in the present invention, in the engine disclosed in U.S. Application Publication No. 2014/0000537A1, the passage for supplying air to the crankcase is referred to as "second passage". This second passage corresponds to the air-fuel mixture passage in the aforementioned carburetor type engine.

A general concept of the present invention will be described with reference to some examples. A first example will be described with reference to FIGS. 1 and 2. FIG. 2 is a cross-sectional view along line II-II in FIG. 1. As with conventional arts, a butterfly valve type carburetor 100 according to a first example includes a gas passage 2, and in the gas passage 2, a choke valve 4 and a throttle valve 6 are disposed. The choke valve 4 is positioned on the upstream side of the throttle valve 6, that is, the air cleaner side. Reference numeral 8 denotes a rotation shaft of the choke valve 4, and reference numeral 10 denotes a rotation shaft of the throttle valve 6.

Each of the choke valve 4 and the throttle valve 6 is comprised of a butterfly valve. When the choke valve 4 and the throttle valve 6 are both fully opened, the gas passage 2 in the carburetor 100 are divided into an air channel 12 and an air-fuel mixture channel 14.

The air channel 12 provides a part of a "first passage (air passage)" in the present invention. The air-fuel mixture channel 14 provides a part of a "second passage (air-fuel mixture passage)" in the present invention. A space between the choke valve 4 and the throttle valve 6 provides a communication portion that brings the air channel 12 and the air-fuel mixture channel 14 into communication with each other. In the communication portion, an inhibition member 16 is placed. The inhibition member 16 includes, for example, a mesh member such as a metal mesh. The mesh member is a mere example of the inhibition member 16. An inhibition member employed in any of various embodiments described later may be employed.

The inhibition member 16 comprised of a mesh member is placed in an entire opening between the choke valve 4 in a full-open position and the throttle valve 6 in a full-open position.

The carburetor 100 according to the present invention is employed in an air leading type two-stroke engine. This engine may be a piston valve type engine or a lead valve type engine (JP Patent Laid-Open No. 10-121973).

In the process of a piston ascending from the bottom dead center, a pressure in the crankcase becomes a negative pressure. As with the conventional arts, an air-fuel mixture produced in the air-fuel mixture channel 14, which provides a part of the "second passage (air-fuel mixture passage)", is supplied to the crankcase by means of the negative pressure in the crankcase. Also, air is supplied to a scavenging channel in the engine through the air channel 12, which provides a part of the "air passage".

Mixed fuel containing oil is supplied to the air-fuel mixture channel 14, whereby an air-fuel mixture is produced in the air-fuel mixture channel 14. Oil components of the mixed fuel adhere to the inhibition member 16, which includes a mesh member, thereby forming a membrane occluding numerous pores of the inhibition member 16.

In the process of the air-fuel mixture entering the crankcase, the negative pressure in the crankcase is exerted in the air-fuel mixture channel 14. Likewise, a negative pressure in the scavenging channel is exerted in the air channel 12; however, the negative pressure exerted in the air-fuel mixture channel 14 is larger. Consequently, through the communication portion between the choke valve 4 and the throttle valve 6, air flows from the air channel 12 into the air-fuel mixture channel 14.

The relatively-larger negative pressure in the air-fuel mixture channel 14 causes air in the air channel 12 to enter the air-fuel mixture channel 14 (arrow indicated in FIG. 2) while breaking the oil component membrane occluding the numerous pores of the inhibition member 16 comprised of a mesh member. Consequently, an engine intake quantity charged into the crankcase can be increased.

In the process of the piston descending, at a moment of the air passage and the air-fuel mixture passage being closed by a piston skirt, a blow-back occurs in the air passage and the air-fuel mixture passage. The numerous ports of the inhibition member 16 are occluded by the membrane of the oil components of the mixed fuel. Consequently, the inhibition member 16 with the oil components of the mixed fuel adhering thereto maintains each of the air channel 12 and the air-fuel mixture channel 14 independent. Consequently, it is possible to inhibit entry of the blow-back of the air-fuel mixture from the air-fuel mixture channel 14 into the air channel 12 through the numerous pores of the inhibition member 16 (mesh member).

As can be understood from the above description, according to the butterfly valve type carburetor 100 in FIGS. 1 and 2, in the air leading type two-stroke engine, a part of the air passing through the air channel 12 (air passage) enters the air-fuel mixture channel 14 (the second passage, that is, the air-fuel mixture passage). Consequently, an engine intake quantity charged in the crankcase can be increased (enhancement of an engine output). Also, entry of the air-fuel mixture into the air channel 12 (air passage) due to blow-back from the engine body is inhibited by the inhibition member 16. Consequently, reduction in amount of HC in gas emissions, which is an advantage of air leading type two-stroke engines, can be achieved. In other words, contamination of the air in the air passage by the air-fuel mixture due to blow-back from the engine body can be inhibited.

FIGS. 3 to 8 indicate a butterfly valve type carburetor according to another example. In description of these figures, components that are the same as those included in the carburetor 100 according to the first example described above are provided with reference numerals that are the same as those of the carburetor 100 according to the first example, and description thereof will be omitted.

FIGS. 3 to 5 illustrate a butterfly valve type carburetor 102 according to a second example. FIG. 4 is a cross-sectional view along line IV-IV in FIG. 3. FIG. 5 is a cross-sectional view along line V-V in FIG. 3. The carburetor 102 according to the second example includes an inhibition member 16 placed in an area corresponding to the opening 412 between the two half partition members 410 in FIG. 63.

FIGS. 6 and 7 illustrate a butterfly valve type carburetor 104 according to a third example. FIG. 7 is a cross-sectional view along line VII-VII in FIG. 6. The carburetor 104 is a carburetor with no choke valve included. In other words, in the carburetor 104 according to the third example, a throttle valve 6 is placed in a gas passage 2 inside the carburetor, and no choke valve 4 such as stated above is included.

In the gas passage 2 inside the carburetor, an inhibition member 16 is disposed on the upstream side of the throttle valve 6, that is, the air cleaner side. The inhibition member 16 may be incorporated in the gas passage 2 of the carburetor 104 in advance, or if the carburetor 104 is directly connected to an air cleaner (not shown), the inhibition member 16 may be incorporated in the air cleaner. When the air cleaner is connected to the carburetor 104, the inhibition member 16 is positioned adjacent to an edge of the throttle valve in a full-open position, and the inhibition member 16 substantially serves as a member providing a part of the carburetor 104.

FIG. 8 is a butterfly valve type carburetor 106 according to a fourth example. As with the carburetor 104 according to the third example above, the carburetor 106 is a carburetor with no choke valve included. Also, the carburetor 106 according to the fourth example is also an alteration of the above-stated second example. In other words, the carburetor 106 includes a configuration in which an inhibition member 16 is incorporated between two half partition members 410, which is conventionally known.

A carburetor according to the present invention is not limited to a butterfly valve type carburetor such as stated above. The present invention is applicable also to the rotary type carburetor disclosed in U.S. Pat. No. 7,261,281 B2.

FIGS. 9 and 10 illustrate an example in which the present invention has been applied to a rotary type carburetor. FIG. 10 is a cross-sectional view along line X10-X10 in FIG. 9. A fundamental configuration of the rotary type carburetor 108 illustrated in FIGS. 9 and 10 is described in detail in U.S. Pat. No. 7,261,281 B2 and thus description thereof will be omitted.

With reference to FIGS. 9 and 10, the rotary type carburetor 108 includes a rotating body 20 housed in a casing 18. The rotating body 20 is rotatable around an axis line 22. The rotating body 20 includes two channels 24 and 26 divided by an inhibition member 16, which is comprised of a net member. One channel 24 is an air channel. The other channel 26 is an air-fuel mixture channel.

As with the respective engines to which the above-stated butterfly valve type carburetors 100, 102, 104 and 106 have been applied, an air leading type two-stroke engine to which the illustrated rotary type carburetor 108 has been applied can increase an engine intake quantity by means of air passing through numerous ports of the inhibition member 16, which is comprised of a net member, when the air and the air-fuel mixture are supplied to an engine body. Also, when the supply of the air and the air-fuel mixture to the engine body is interrupted, entry of blown-back air-fuel mixture into the air channel 24 can be inhibited by the inhibition member 16.

The present invention is not limited to the above-stated carburetors. As can be understood from FIGS. 11 and 12, in an intake system in an air leading type two-stroke engine, a communication portion and an inhibition member may be positioned upstream or downstream of a carburetor. FIG. 11 illustrates an example of an air leading type two-stroke engine according to the present invention. The engine 110 shown in FIG. 11 includes an intake system 36 extending from a filter element 32 of an air cleaner 30 to an engine body 34. The intake system 36 includes a carburetor 38.

The intake system 36 includes an air passage 40 and an air-fuel mixture passage 42. The intake system 36 also includes a communication portion 44 that brings the air passage 40 and the air-fuel mixture passage 42 into communication with each other. In the communication portion 44, an inhibition member 16 comprised of a mesh member such as stated above is disposed. The communication portion 44 is positioned on an arbitrary point between the carburetor 38 and the filter element 32.

The illustrated engine 110 also enables an increase in an engine intake quantity entering into the engine body 34 by means of the communication portion 44. Also, the illustrated engine 110 enables entry of blown-back air-fuel mixture into the air passage 40 through the communication portion 44 to be inhibited by the inhibition member 16.

FIG. 12 illustrates another example of an air leading type two-stroke engine according to the present invention. The engine 112 shown in FIG. 12 includes a communication portion 44 formed between a carburetor 38 and an engine body 34 in an intake system 36. An inhibition member 16, which is comprised of a mesh member, is attached to the communication portion 44.

The engine 112 illustrated in FIG. 12 also enables an increase in an engine intake quantity entering into the engine body 34 by means of the communication portion 44. Also, the engine 112 enables entry of blown-back air-fuel mixture to the air passage 40 through the communication portion 44 to be inhibited by the inhibition member 16.

The carburetor 38 illustrated in FIGS. 11 and 12 is a butterfly valve type carburetor, but may be a rotary type carburetor.

Although FIGS. 11 and 12 illustrate a common throttle valve 6 shared by the air passage 40 (corresponding to the "first passage") and the air-fuel mixture passage 42 (corresponding to the "second passage"), as an alteration, a control valve may be provided in each of the air passage 40 and the air-fuel mixture passage 42.

Various examples of carburetor type engines included in the general concept of the present invention have been described with reference to FIGS. 1 to 12. The present invention is applicable also to fuel injection valve type two-stroke engines (U.S. Application Publication No. 2014/0000537A1).

FIG. 13 illustrates an example in which the present invention has been applied to a fuel injection valve type two-stroke engine. The engine 114 shown in FIG. 13 includes a fuel injection valve 50 placed facing a crankcase of an engine body 34. An intake system 52 of the engine 114 includes an air passage 54 and a second passage 56. Air is supplied to a scavenging channel (not shown) through the air passage 54. Air is supplied to the crankcase through the second passage 56. In the crankcase, an air-fuel mixture is produced from fuel injected from the fuel injection valve 50 and the air supplied through the second passage 56.

The intake system 52 includes a communication portion 44. The communication portion 44 brings the air passage 54 and the second passage 56 into communication with each other. The communication portion 44 may be positioned on an arbitrary point between a filter element 32 and an engine body 34. In the communication portion 44, an inhibition member 16 comprised of a mesh member such as stated above is placed.

The fuel injection valve type engine 114 shown in FIG. 13 also enables an engine intake quantity into the engine body 34 to be increased by the communication portion 44. Also, the fuel injection valve type engine 114 enables entry of blown-back air-fuel mixture into the air passage 54 through the communication portion 44 to be inhibited by the inhibition member 16.

The general concept of the present invention has been described above based on various examples. The above description is based on examples of a mesh member being employed as an inhibition member 16. Instead of a mesh member, an inhibition member 16 may include a plate including a plurality of pores.

FIGS. 14 and 15 illustrate a part of a plate-like inhibition member 16 that can be placed in a communication portion 44. The inhibition member 16 includes a plurality of pores 60. In FIG. 14, each of the pores 60 has a tapered shape. In other words, in each of the pores 60 illustrated in FIG. 14, an air channel 12-side opening 60*a* is large compared to an air-fuel mixture channel 14-side opening 60*b*. Consequently, air in the air channel 12 easily enters the pores 60. Therefore, if gas flows in a forward direction in each of the air channel 12 and the air-fuel mixture channel 14, a flow of air from the air channel 12 to the air-fuel mixture channel 14 through the pores 60 occurs. If gas flows in a reverse direction in each of the air channel 12 and the air-fuel mixture channel 14, entry of a blow-back of the air-fuel mixture in the air-fuel mixture channel 14 into the air channel 12 through the pores 60 is inhibited.

Also, as can be seen from FIG. 15, each of the pores 60 may be placed with an axis line P thereof inclined. In other words, the air channel 12-side opening 60*a* of each pore 60 is set close to the engine body side relative to the air-fuel mixture channel 14-side opening 60*b*. An angle of inclination of each pore 60 is indicated by "θ" in FIG. 15. When a gas flows in a reverse direction, the inclination "θ" enables a blow-back of air in the air channel 12 to be guided to the air-fuel mixture channel 14 through the pores 60. Consequently, entry of a blow-back of the air-fuel mixture in the air-fuel mixture channel 14 into the air channel 12 can be inhibited.

Although examples in which an inhibition member 16 includes a mesh member or a plate member including pores 60 have been described above, the inhibition member 16 includes various modes as can be seen from the embodiments described below.

DETAILED DESCRIPTION OF THE PRESENT INVENTION

Preferred embodiments of the present invention will be described below with reference to the drawings.

Figure 16:
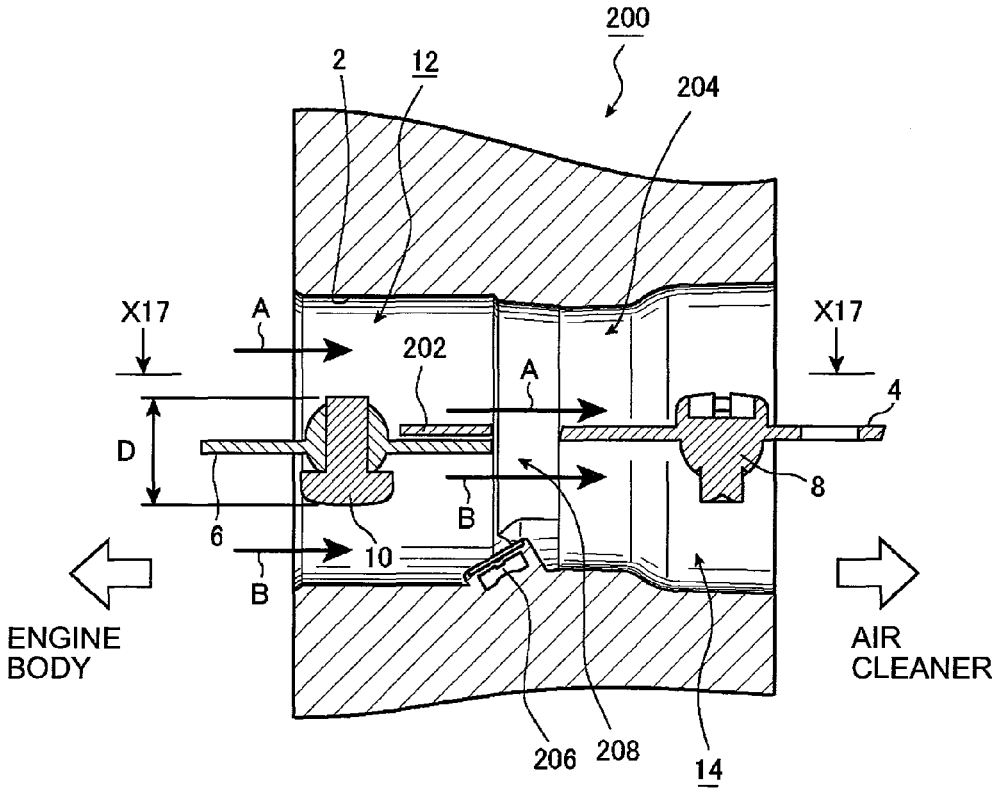
FIG. 16 is a vertical cross-sectional view of a gas passage in a carburetor according to a first embodiment.
Figure 17:
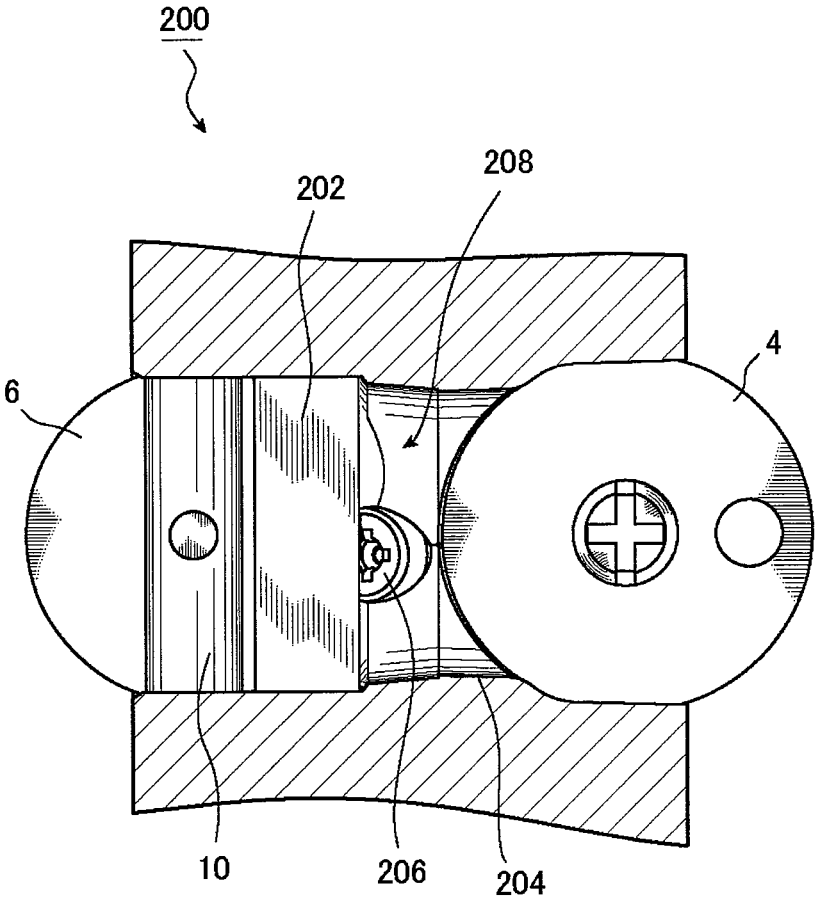
FIG. 17 is a cross-sectional view alone line X17-X17 indicated in FIG. 16.
Figure 18:
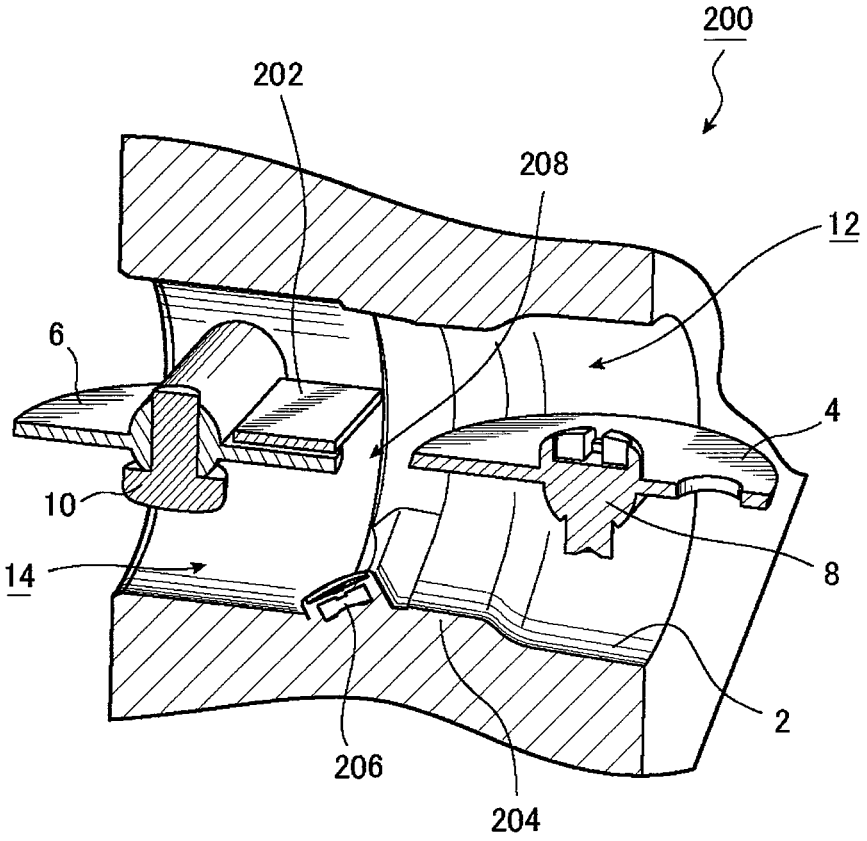
FIG. 18 is a perspective view of a cross-section indicated in FIG. 16.

First Embodiment (FIGS. 16 to 18)

FIGS. 16 to 18 illustrate a carburetor 200 according to a first embodiment. The illustrated carburetor 200 is employed in an air leading type two-stroke engine. In FIGS. 16 to 18, components that are the same as those described with reference to FIG. 1, etc., are provided with reference numerals that are the same as those in FIG. 1, etc.

The carburetor 200 includes an inhibition member 202 comprised of a flat plate. The inhibition member 202 is disposed in the vicinity of a throttle valve 6. More specifically, the inhibition member 202 is positioned upstream of and adjacent to the throttle valve 6.

The inhibition member 202 is positioned in the air channel 12 and extends across the air channel 12. The flat plate-like inhibition member 202 is parallel to the throttle valve 6 in a full-open position. The inhibition member 202 is preferably placed close to a surface of the throttle valve 6 in the full-open position. More preferably, the inhibition member 202 is placed within a range of a diameter D (FIG. 16) of a rotation shaft 10 of the throttle valve 6.

In FIGS. 16 to 18, reference numeral 204 denotes a venturi portion, and reference numeral 206 denotes a main nozzle. Mixed fuel containing oil is supplied to the air-fuel mixture channel 14 through the main nozzle 206.

When gas flows in a "forward direction" in a gas passage 2 inside the carburetor 200, that is, air flows toward a scavenging channel of an engine body and an air-fuel mixture flows toward a crankcase, a negative pressure that is large relative to that of the air channel 12 is exerted in the air-fuel mixture channel 14 that communicates with the crankcase. The large negative pressure causes air to flow from the air channel 12 into the air-fuel mixture channel 14 through an opening 208. Consequently, an engine intake quantity of the engine body can be increased.

In FIG. 16, arrows indicate blow-back flows A and B. A direction of the blow-back flows is a "reverse direction" mentioned above. Reference sign A denotes a blow-back flow of the air in the air channel 12. Reference sign B denotes a blow-back flow of the air mixture in the air-fuel mixture channel 14. These blow-back flows A and B run from an engine body toward an air cleaner. The blow-back flow A in the air channel 12 is set to be a flow that is parallel to the throttle valve 6 by the inhibition member 202 (FIG. 16).

The inhibition member 202 has a function that guides the blow-back flow A of the air to form a gas barrier in the opening 208 between the choke valve 4 and the throttle valve 6, that is, a communication portion that brings the air channel 12 and the air-fuel mixture channel 14 into communication with each other. The gas barrier inhibits entry of the blow-back flow B of the air-fuel mixture in the air-fuel mixture channel 14 into the air channel 12 through the opening 208.

In the illustrated carburetor 200, the inhibition member 202 is placed in the air channel 12; however, the inhibition member 202 may be placed in the air-fuel mixture channel 14. In other words, the inhibition member 202 may be placed in the air-fuel mixture channel 14 instead of the air channel 12 or may be placed in each of the air channel 12 and the air-fuel mixture channel 14.

Figure 19:
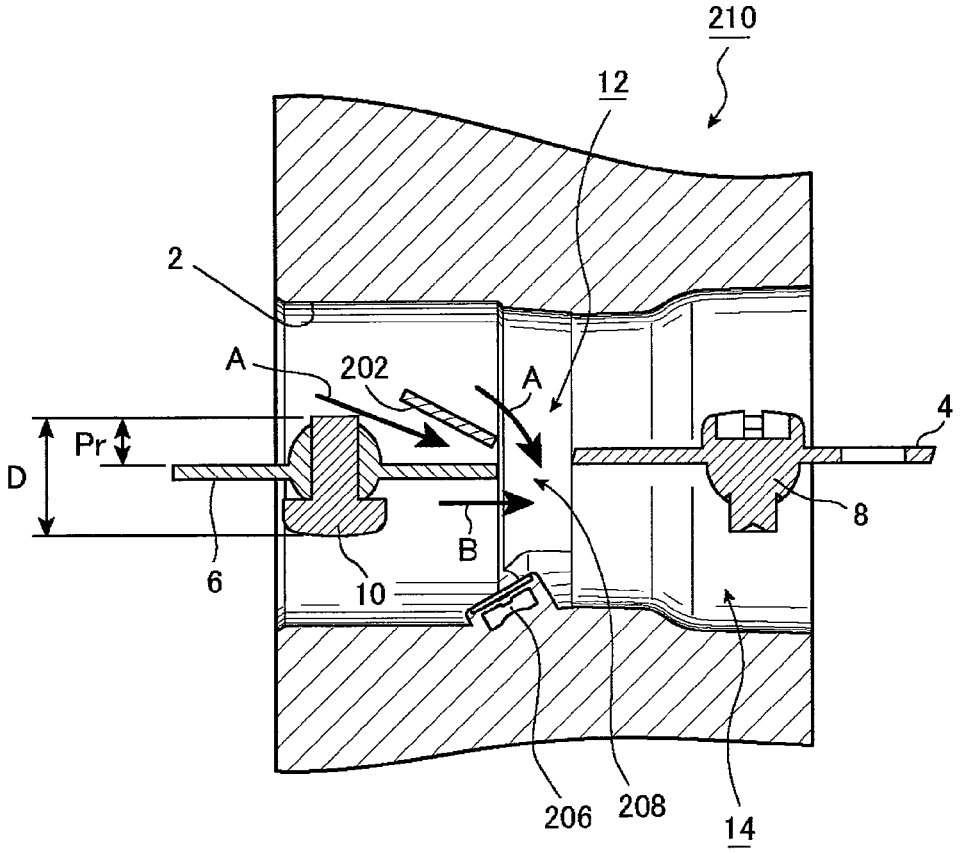
FIG. 19 is a vertical cross-sectional view of a gas passage in a carburetor according to a second embodiment.

Second Embodiment (FIG. 19)

FIG. 19 illustrates a carburetor 210 according to a second embodiment. The carburetor 210 according to the second embodiment is an alteration relating to placement of the inhibition member 202 comprised of a flat plate in the first embodiment.

Referring to FIG. 19, an inhibition member 202 is placed in the vicinity of a throttle valve 6 in an air channel 12. Also, the inhibition member 202, which is comprised of a flat plate, is placed with an inclination relative to the throttle valve 6 in a full-open position, in side view. The inclined inhibition member 202 deflects a part of a blow-back flow A of air in an air channel 12 in a direction toward an opening 208 (communication portion).

The inhibition member 202 comprised of a flat plate, which is placed with an inclination, is preferably placed within a range of an area Pr in which a rotation shaft 10 projects from the throttle valve 6; however, as illustrated, the inhibition member 202 may be placed so as to slightly project from the area Pr. Consequently, as can be understood from FIG. 19, a blow-back flow A running between the inhibition member 202 and the throttle valve 6 can be directed to the opening 208 (communication portion).

By means of the inhibition member 202 included in the second embodiment, the blow-back flow A of air is guided toward the opening 208 (communication portion). The blow-back flow A of air forms a gas barrier having directionality. The gas barrier enables active inhibition of entry of a blow-back flow B of the air-fuel mixture in the air-fuel mixture channel 14 into the air channel 12 through the opening 208.

Figure 20:
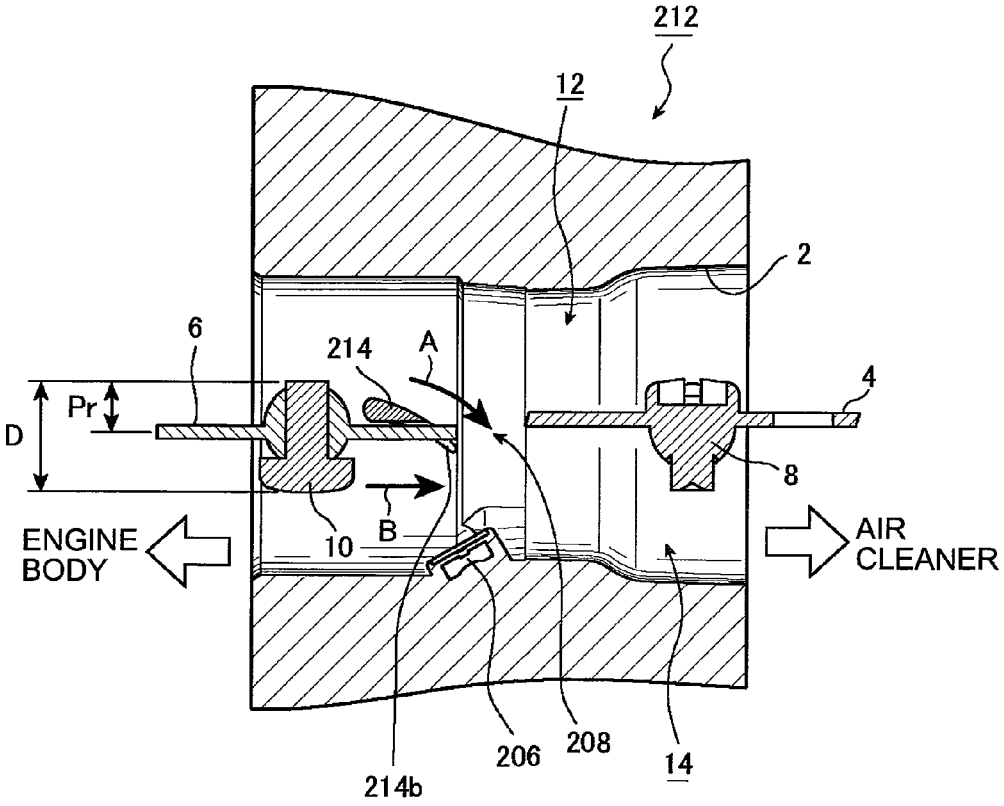
FIG. 20 is a vertical cross-sectional view of a gas passage in a carburetor according to a third embodiment.
Figure 21:
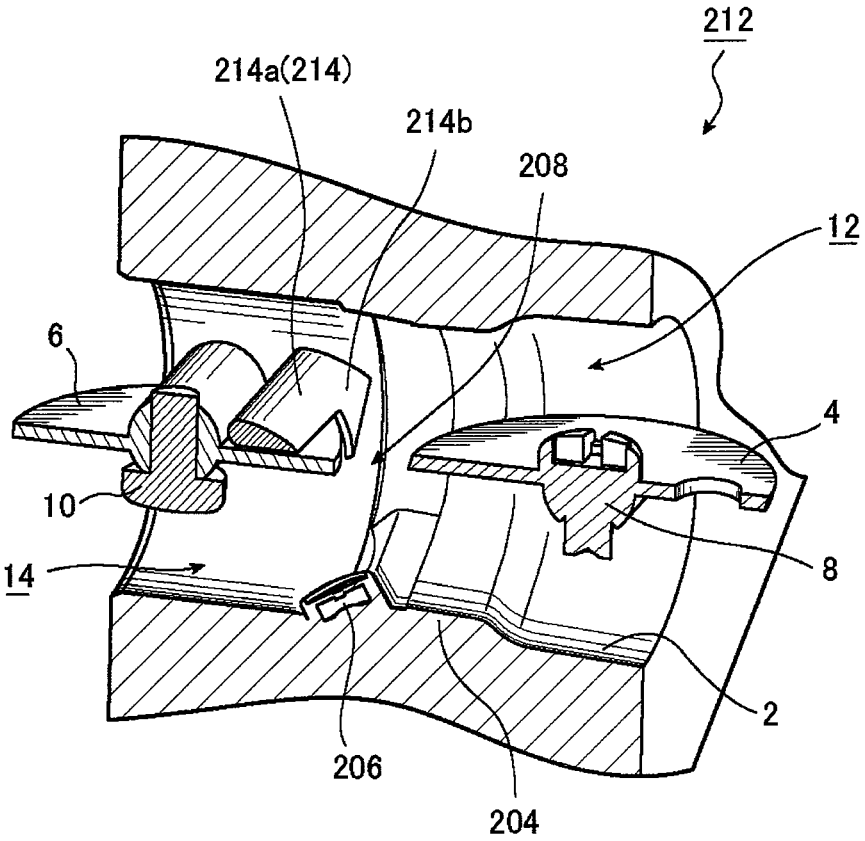
FIG. 21 is a perspective view of the cross-section illustrated in FIG. 20.
Figure 22:
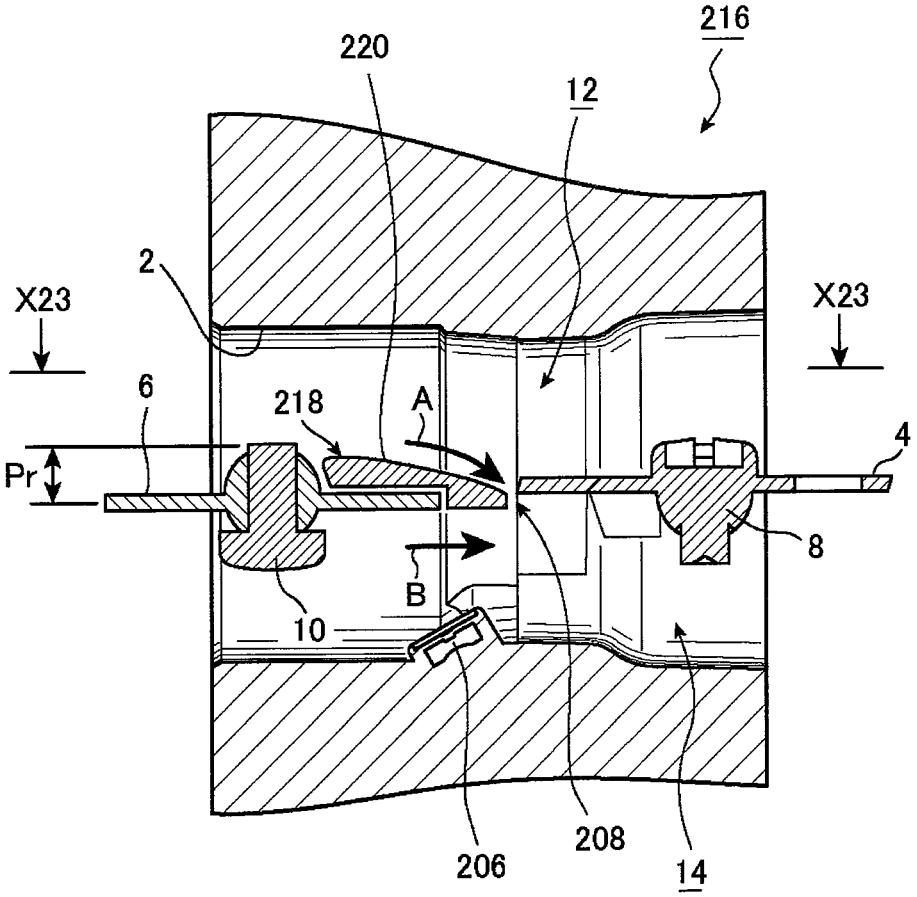
FIG. 22 is a vertical cross-sectional view of a gas passage in a carburetor according to a fourth embodiment.

Third Embodiment (FIGS. 20 and 21)

FIGS. 20 and 21 illustrate a carburetor 212 according to a third embodiment. The carburetor 212 according to the third embodiment includes a wing-like inhibition member 214 placed in the air channel 12. The inhibition member 214 is placed adjacent to a throttle valve 6. A wing-like body 214*a* (FIG. 21) of the inhibition member 214 extends across the air channel 12 in planar view. It is favorable that the wing-like body 214*a* of the inhibition member 214 be placed within a range of the aforementioned projection area Pr of the rotation shaft 10 in order to secure an amount of air passing through the air channel 12 (FIG. 20). Consequently, a resistance caused by the projection of the rotation shaft 10 can be inhibited.

As can be understood from FIG. 21, the inhibition member 214 includes an extended guide portion 214*b* on each of opposite sides thereof. The extended guide portion 214*b* has an outline shape along the throttle valve 6 in a full-open position, that is, a butterfly valve in a full-open position, in planar view. The extended guide portion 214*b* extends from the wing-like body 214*a* toward an opening 208. The extended guide portion 214*b* may preferably have an inclined shape extending to the opening 208 and may more preferably extend to an air-fuel mixture channel 14 through the opening 208.

The extended guide portion 214*b* may have a flat plate-like shape or may have a shape curved in a concave shape toward the air-fuel mixture channel 14 as illustrated.

A blow-back flow A of air is guided toward the opening 208 (communication portion) by the wing-like inhibition member 214 included in the third embodiment (FIG. 20). The blow-back flow A of air forms a gas barrier having directionality. The gas barrier enables active inhibition of entry of a blow-back flow B of the air-fuel mixture inside the air-fuel mixture channel 14 into the air channel 12 through the opening 208. Also, the extended guide portion 214*b* has a function that deflects the blow-back flow B of the air-fuel mixture and guides the blow-back flow B of the air-fuel mixture toward a center of the air-fuel mixture channel 14.

Fourth Embodiment (FIGS. 22 to 26)

FIGS. 22 to 26 illustrate a carburetor 216 according to a fourth embodiment. An inhibition member 218 included in the carburetor 216 according to the fourth embodiment is in common with the inhibition member 214 included in the third embodiment in terms of having a wing-like shape. As in the third embodiment, the inhibition member 218 is placed in an air channel 12 and adjacent to a throttle valve 6.

Figure 23:
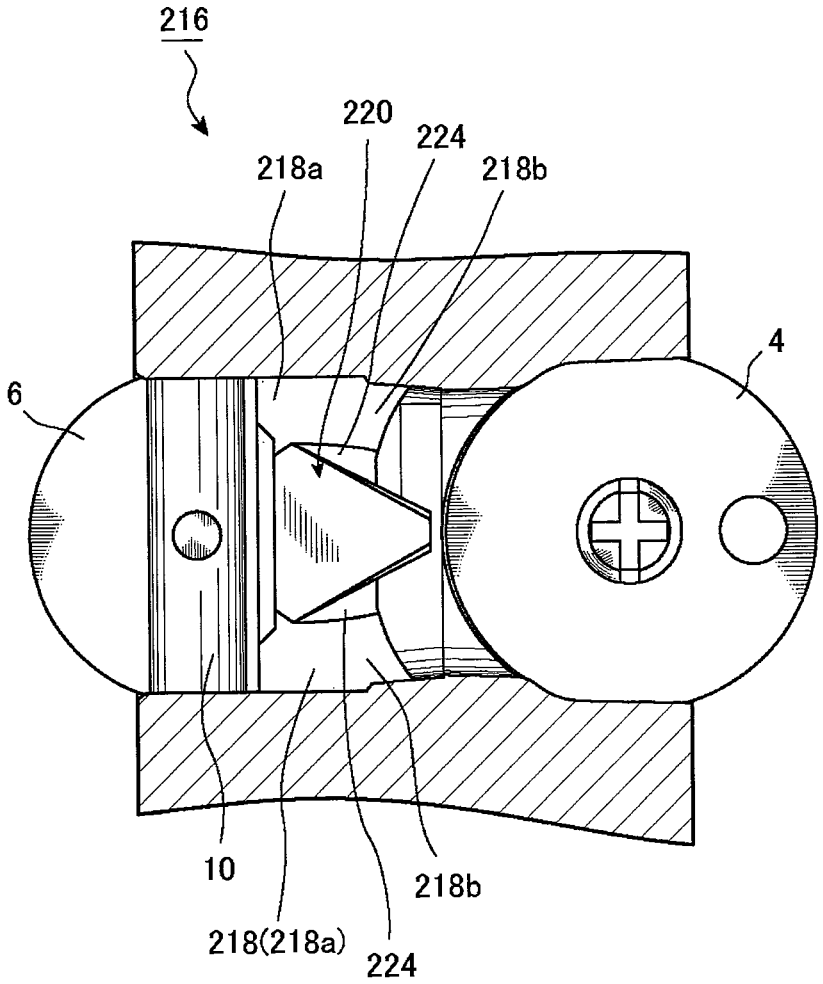
FIG. 23 is a horizontal cross-sectional view of the gas passage along line X23-X23 indicated in FIG. 22.
Figure 24:
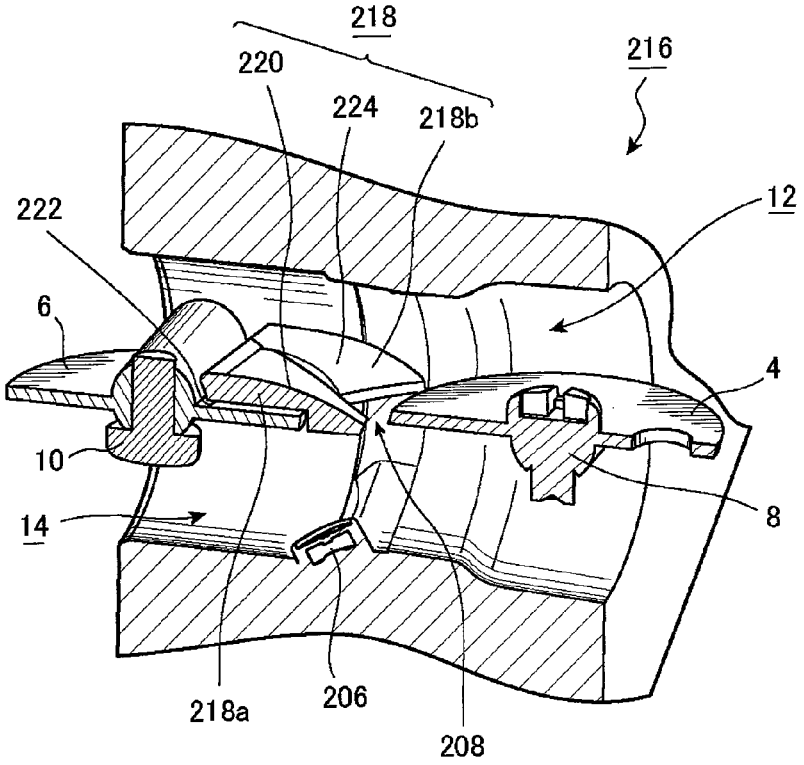
FIG. 24 is a perspective view of the cross-section illustrated in FIG. 22.
Figure 25:
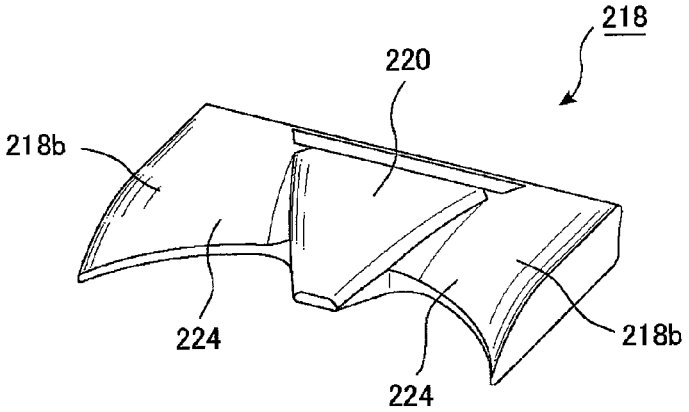
FIG. 25 is a perspective view of an inhibition member included in the carburetor illustrated in FIG. 22.
Figure 26:
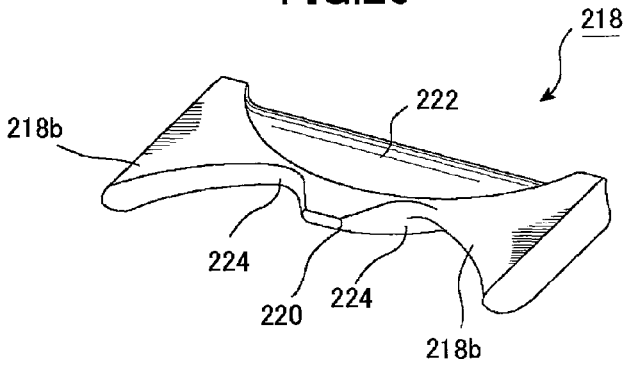
FIG. 26 is a vertically-reversed perspective view of the inhibition member illustrated in FIG. 25.
Figure 27:
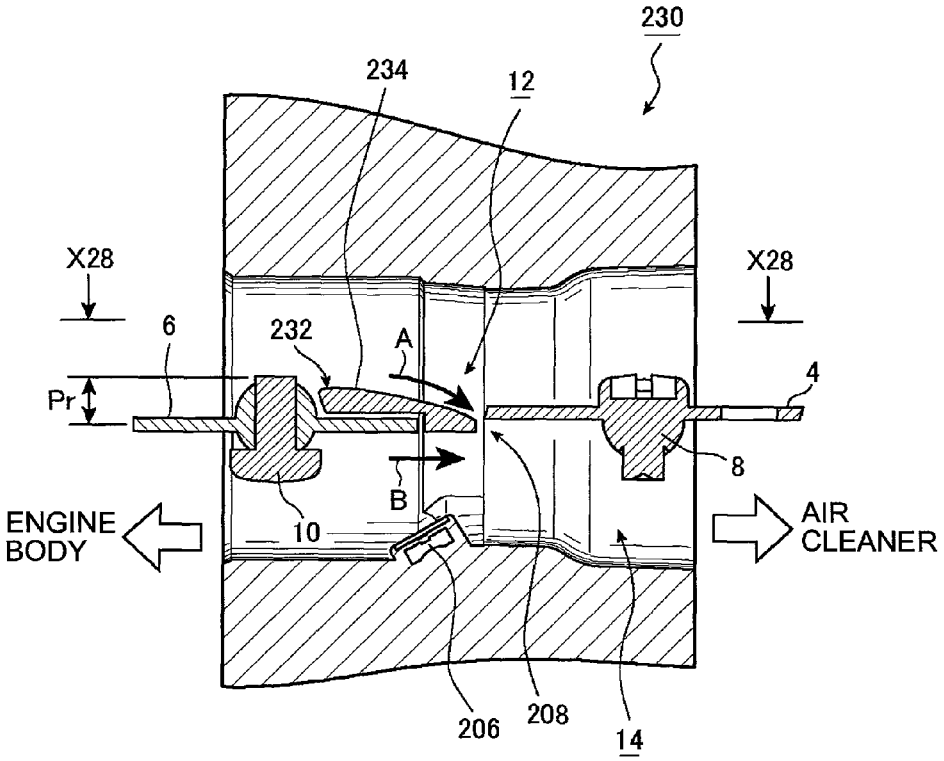
FIG. 27 is a vertical cross-sectional view of a gas passage in a carburetor according to a fifth embodiment.

Referring to FIGS. 23 and 25, the wing-like inhibition member 218 included in the fourth embodiment includes a convex portion 220 at a center portion of the inhibition member 218 in planar view. FIG. 25 is a perspective view of the inhibition member 218. FIG. 26 illustrates the inhibition member 218 in a vertically-reversed state. The dent 222 illustrated in FIG. 26 is a part that receives a throttle valve 6 in a full-open position, and has an outer contour that is complementary to a circular-arc outer shape of the throttle valve 6.

Referring to FIGS. 23 and 25, the center convex portion 220 includes an extended guide portion 218*b* extending on each of opposite sides thereof. Each extended guide portion 218*b* has a cross-sectional shape curved from the center convex portion 220 toward a side edge, and a concave portion 224 is formed between each extended guide portion 218*b* and the center convex portion 220. The center convex portion 220 preferably has a shape extending to the opening 208, and more preferably has a shape extending to an air-fuel mixture channel 14.

The center convex portion 220 has a shape tapered in a flow direction of a blow-back flow A of air in planar view. Consequently, the blow-back flow A of air passing by the concave portion 224 positioned on each of the opposite sides of the center convex portion 220 can be actively directed to the upstream side of the main nozzle 206. In other words, the blow-back flow A of air is intensively guided to the upstream side of the main nozzle 206 by the two concave portions 224 positioned on the opposite sides of the center convex portion 220. Consequently, the blow-back flow A of air can be guided to the air-fuel mixture channel 14 without interruption of a forward gas flow in the main nozzle, ensuring stable fuel supply from the main nozzle.

The above-described extended guide portion 218*b* may have a shape enlarging toward the upstream side of the throttle valve 6. The same applies to the extended guide portions 214*b* included in the third embodiment.

The blow-back flow A of air is guided toward the opening 208 (communication portion) by the wing-like inhibition member 218 included in the fourth embodiment. The blow-back flow A of air enables active inhibition of entry of a blow-back flow B of the air-fuel mixture in the air-fuel mixture channel 14 into the air channel 12 through the opening 208. Also, the extended guide portions 218*b* deflect a flow direction of the blow-back flow B of the air-fuel mixture and guide the blow-back flow B toward the inside, that is, a center portion of the air-fuel mixture channel 14.

Fifth Embodiment (FIGS. 27 to 31)

FIGS. 27 to 31 illustrate a carburetor 230 according to a fifth embodiment. An inhibition member 232 included in the carburetor 230 according to the fifth embodiment is in common with the inhibition members 214 and 218 according to the third and four embodiments described above in terms of having a wing-like shape as a basic structure. As in the third embodiment, etc., the inhibition member 232 is placed in the air channel 12 and adjacent to a throttle valve 6.

Figure 28:
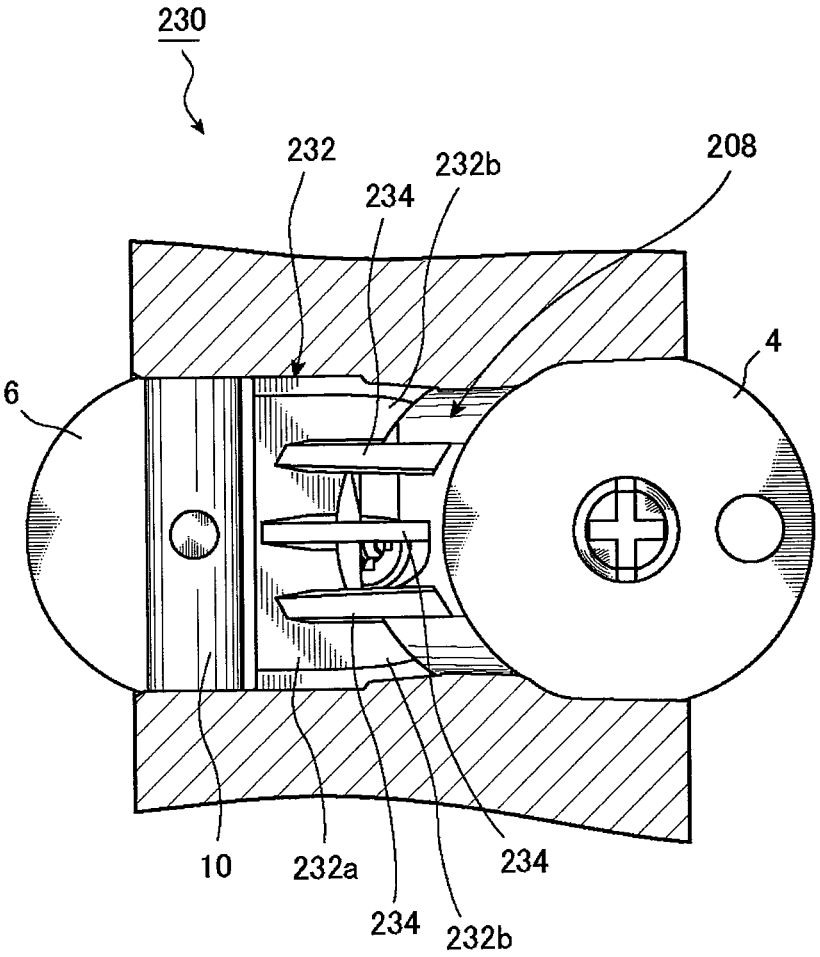
FIG. 28 is a horizontal cross-sectional view of the gas passage in the carburetor in FIG. 27 along line X28-X28.

As in the third embodiment, etc., the inhibition member 232 includes a wing-like body 232*a* and extended guide portions 232*b* (FIG. 28).

The inhibition member 232 included in the fifth embodiment includes a plurality of standing walls 234 at a center part thereof in planar view. The plurality of standing walls 234 preferably extend along an axis line of the air channel 12. The plurality of standing walls 234 extend in parallel to one another.

A blow-back flow A of air is guided toward an opening 208 (communication portion) by the wing-like inhibition member 232 included in the fifth embodiment. The blow-back flow A of air enables active inhibition of entry of a blow-back flow B of the air-fuel mixture inside an air-fuel mixture channel 14 in the air channel 12 through the opening 208. Also, the extended guide portions 232*b* deflect the blow-back flow B of the air-fuel mixture and guide the blow-back flow B toward a center of the air-fuel mixture channel 14.

Figure 29:
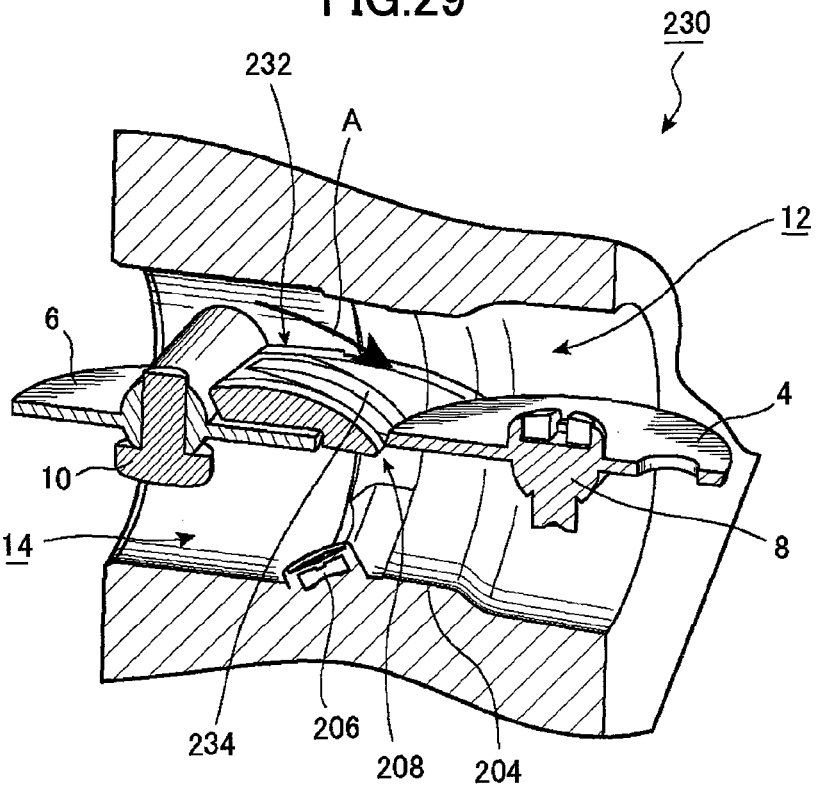
FIG. 29 is a perspective view of the cross-section illustrated in FIG. 27.
Figure 30:
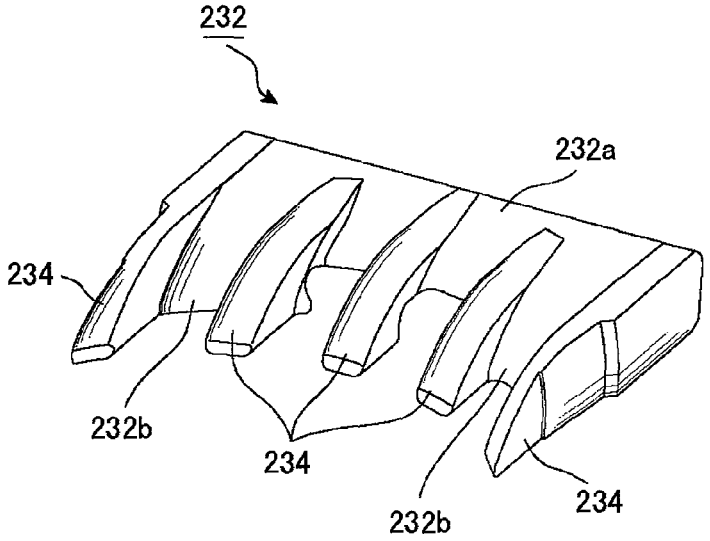
FIG. 30 is a perspective view of an inhibition member included in the carburetor illustrated in FIG. 27.
Figure 31:
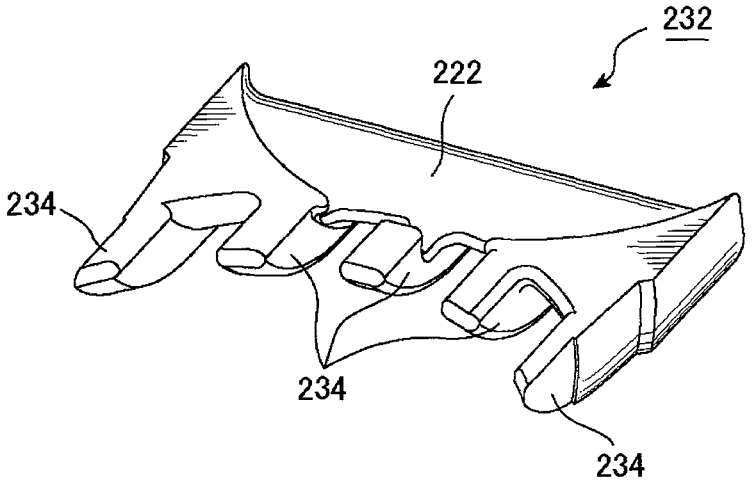
FIG. 31 is a vertically-reversed perspective view of the inhibition member illustrated in FIG. 30.

Also, the plurality of standing walls 234 extending in parallel to one another in the inhibition member 232 has a function that rectifies the blow-back flow A of air and a guide function, and the rectifying function and the guide function enable the blow-back flow A of the air to be actively directed to the upstream side of a main nozzle 206 (FIG. 29).

Sixth Embodiment (FIGS. 32 to 35)

FIGS. 32 to 35 illustrate a carburetor 236 according to a sixth embodiment. An inhibition member 238 included in the carburetor 236 according to the sixth embodiment is placed upstream of a throttle valve 6 and adjacent to a choke valve 4. Also, the inhibition member 238 is placed in an air-fuel mixture channel 14.

Figure 34:
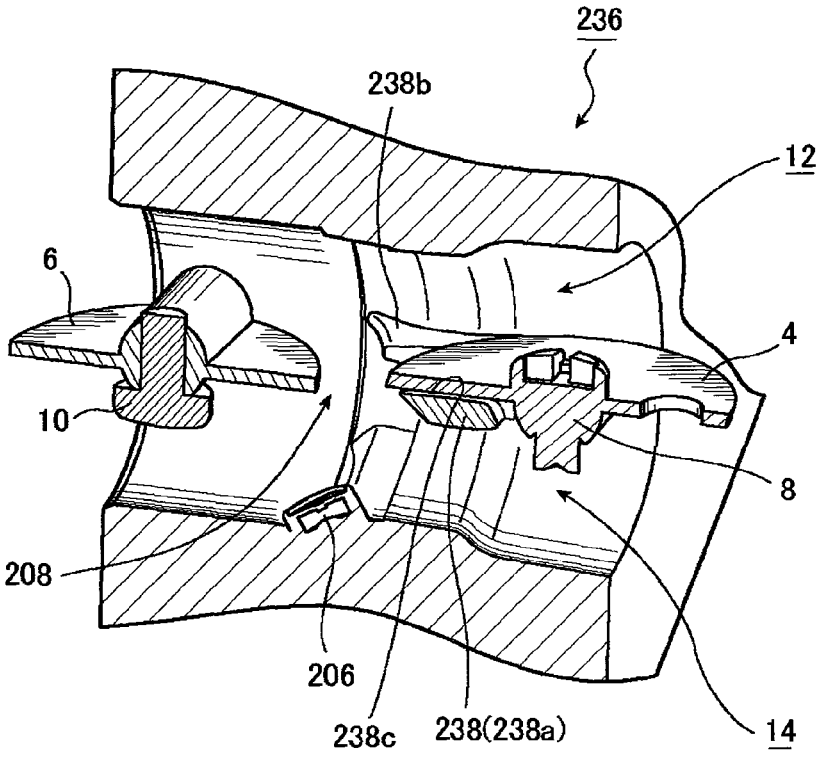
FIG. 34 is a perspective view of the cross-section illustrated in FIG. 32.
Figure 35:
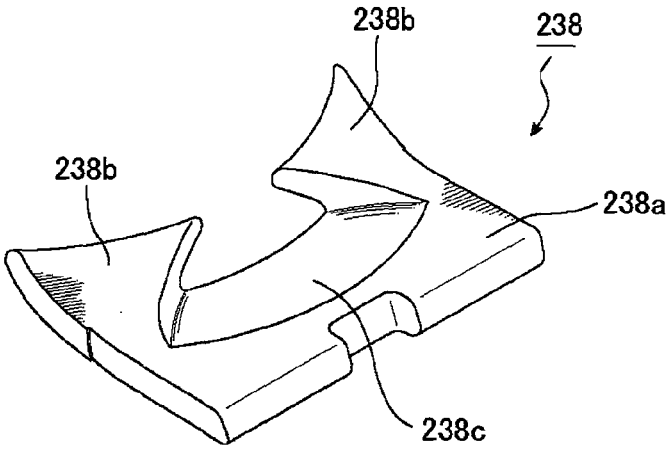
FIG. 35 is a perspective view of an inhibition member included in the carburetor illustrated in FIG. 32.

The inhibition member 238 includes a flat plate-like body 238*a* positioned adjacent to the choke valve 4 in a full-open position, the choke valve 4 comprised of a butterfly valve, in the air-fuel mixture channel 14 (FIGS. 34 and 35). The flat plate-like body 238*a* positioned in the air-fuel mixture channel 14 extends in parallel to the choke valve 4 in a full-open position. Also, the flat plate-like body 238*a* extends across the air-fuel mixture channel 14. In FIGS. 34 and 35, reference numeral 238*c* denotes a dent that receives the choke valve 4 in a full-open position.

The inhibition member 238 includes an extended guide portion 238*b* on each of opposite sides thereof in planar view. As illustrated, each extended guide portion 238*b* preferably has a shape projecting to the downstream side of the choke valve 4. The extended guide portions 238*b* have respective shapes entering opposite side portions of an opening 208. In this embodiment, each extended guide portion 238*b* has a shape curved in a convex toward the opening 208. Each extended guide portion 238*b* preferably has a shape extending to an air channel 12 through the opening 208. The extended guide portions 238*b* on the opposite sides of the inhibition member 238 may exist in a center part in a longitudinal direction of the inhibition member 238.

The inhibition member 238 included in the sixth embodiment enables entry of a part of a blow-back flow B of the air-fuel mixture in the air-fuel mixture channel 14 into the air channel 12 to be inhibited by the extended guide portions 238*b* at the opposite side portions thereof. In other words, referring to FIG. 32, even if the blow-back flow B of the air-fuel mixture running on the opposite side portions of the air-fuel mixture channel 14 is about to enter the air channel 12 through the opposite side portions of the opening 208, the extended guide portions 238*b* deflect the flow direction of the blow-back flow B and guide the blow-back flow B to the inside, that is, a center portion of the air-fuel mixture channel 14.

Figure 32:
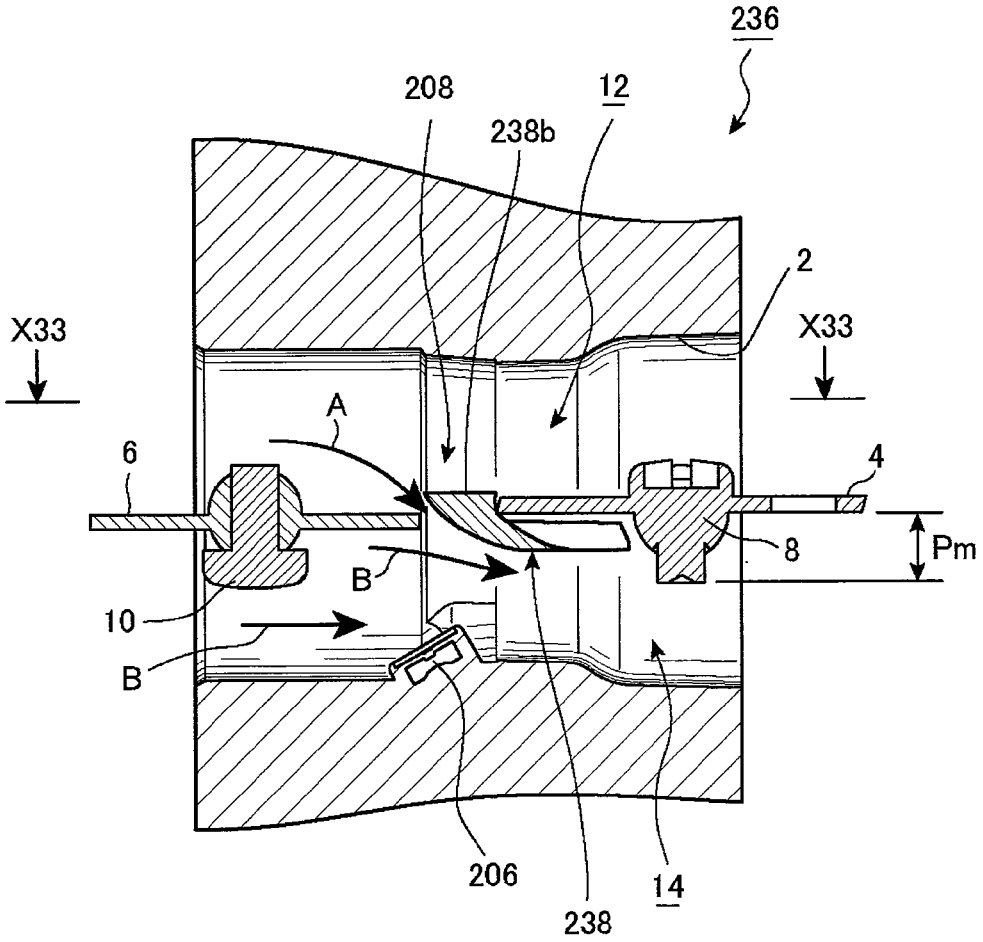
FIG. 32 is a vertical cross-sectional view of a gas passage in a carburetor according to a sixth embodiment.
Figure 33:
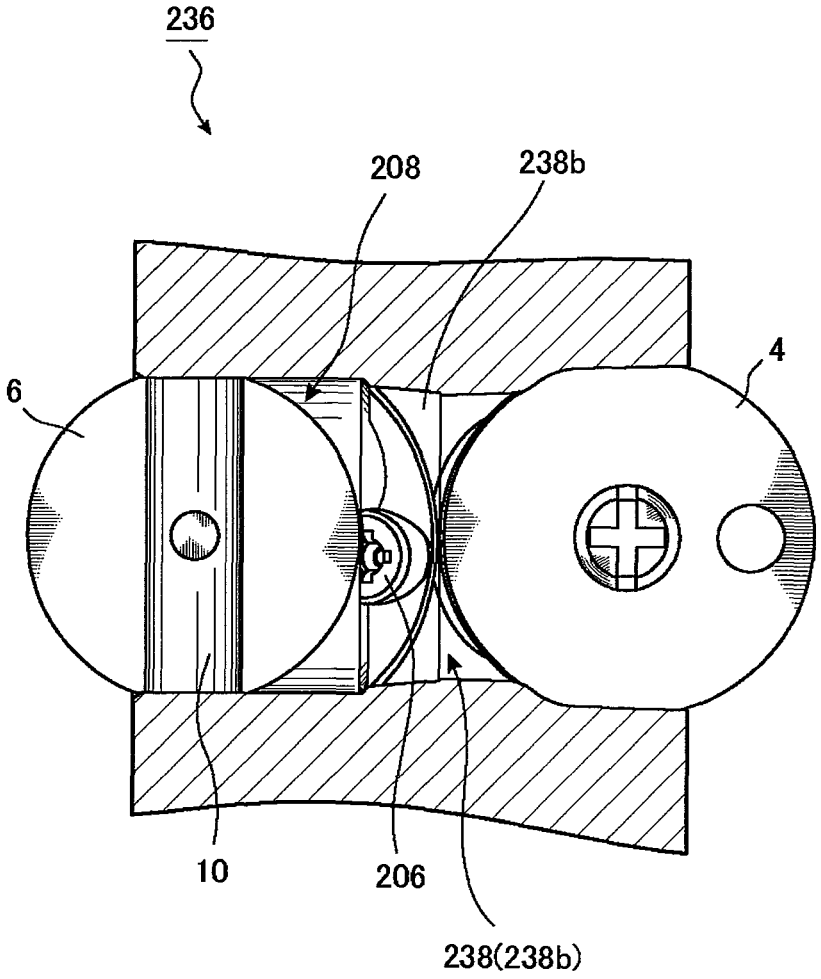
FIG. 33 is a horizontal cross-sectional view of the gas passage illustrated in FIG. 32 along line X33-X33.

In the air channel 12, the inhibition member 238 may be placed adjacent to the throttle valve 6. If the inhibition member 238 is placed in the air channel 12, operation and effects that are substantially the same as those of the third embodiment described with reference to FIGS. 20 and 21 can be exerted (FIG. 32).

Figure 36:
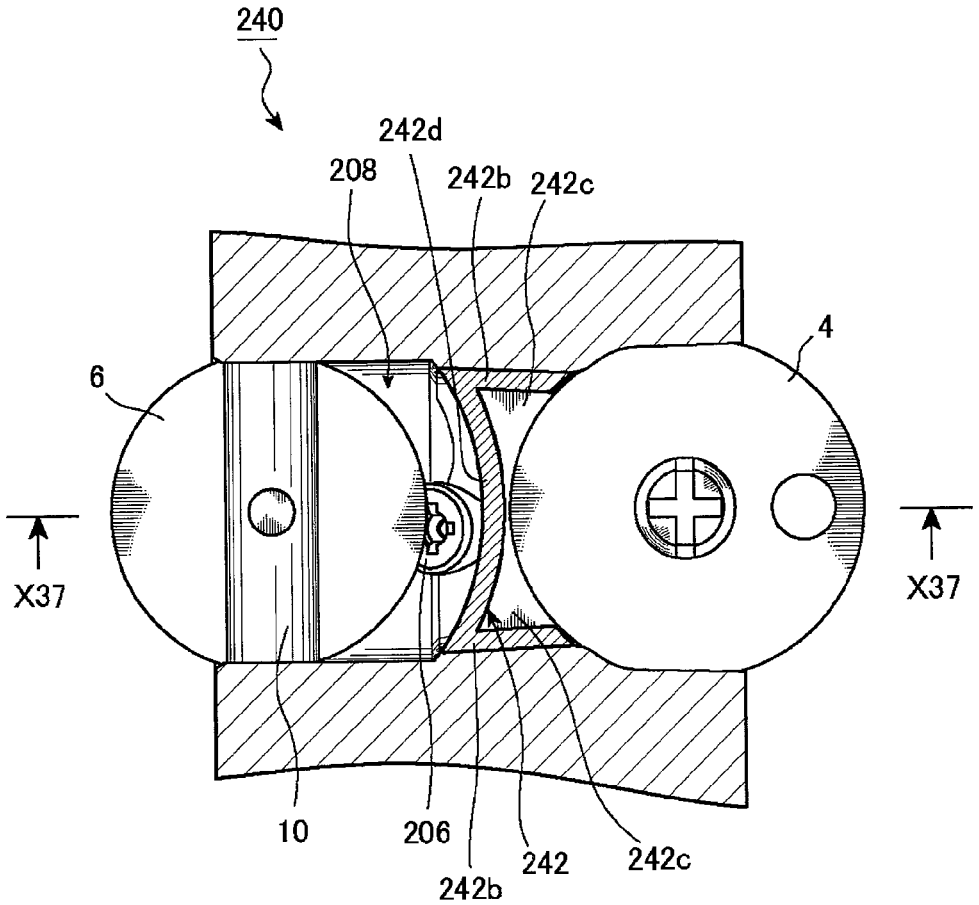
FIG. 36 is a horizontal cross-sectional view of a gas passage in a carburetor according to a seventh embodiment.
Figure 37:
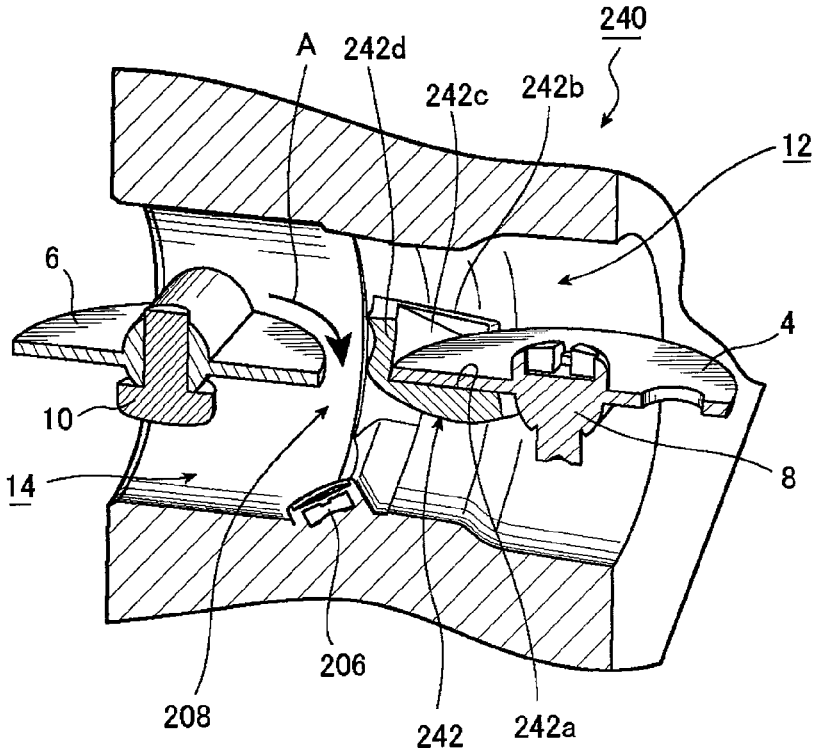
FIG. 37 is a perspective view of the cross-section along line X37-X37 in FIG. 36.
Figure 38:
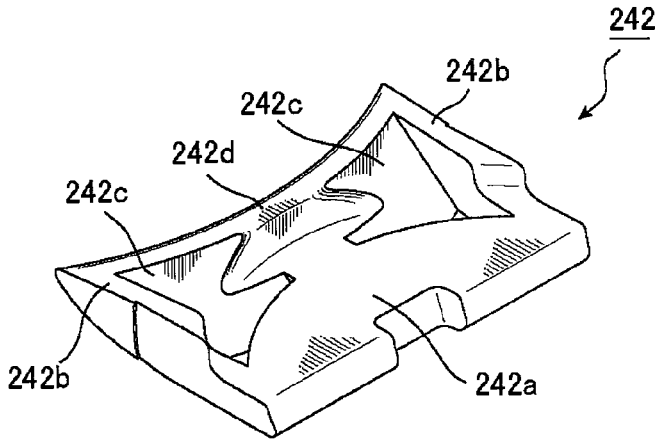
FIG. 38 is a perspective view of an inhibition member included in the carburetor illustrated in FIG. 36.

Seventh Embodiment (FIGS. 36 to 38)

FIGS. 36 to 38 illustrate a carburetor 240 according to a seventh embodiment. An inhibition member 242 included in the carburetor 240 according to the seventh embodiment is also an alteration of the inhibition member 238 included in the sixth embodiment described above.

The inhibition member 242 included in the seventh embodiment includes extended guide portions 242*b*, which are similar to the extended guide portion 238*b* described in the sixth embodiment, and an extended guide portion 242*b* is formed also at a center part in a longitudinal direction of the inhibition member 242. Consequently, even though parts of a blow-back flow B of the air-fuel mixture running in not only opposite side portions but also a center part in a width direction of the air-fuel mixture channel 14 are about to enter an air channel 12 through an opening 208, the extended guide portions 242*b* can deflect the flow direction of the parts of the blow-back flow B to guide the parts of the blow-back flow B to the inside of the air-fuel mixture channel 14.

The inhibition member 242 includes a guide wall 242*d* at a downstream edge thereof, and the guide wall 242*d* stands toward a center of the air channel 12. The guide wall 242*d* can direct a blow-back flow A of air toward an opening 208.

The inhibition member 242 may arbitrarily include a window 242*c* (FIG. 38). Also, a mesh member may be assembled to the window 242*c*.

Figure 39:
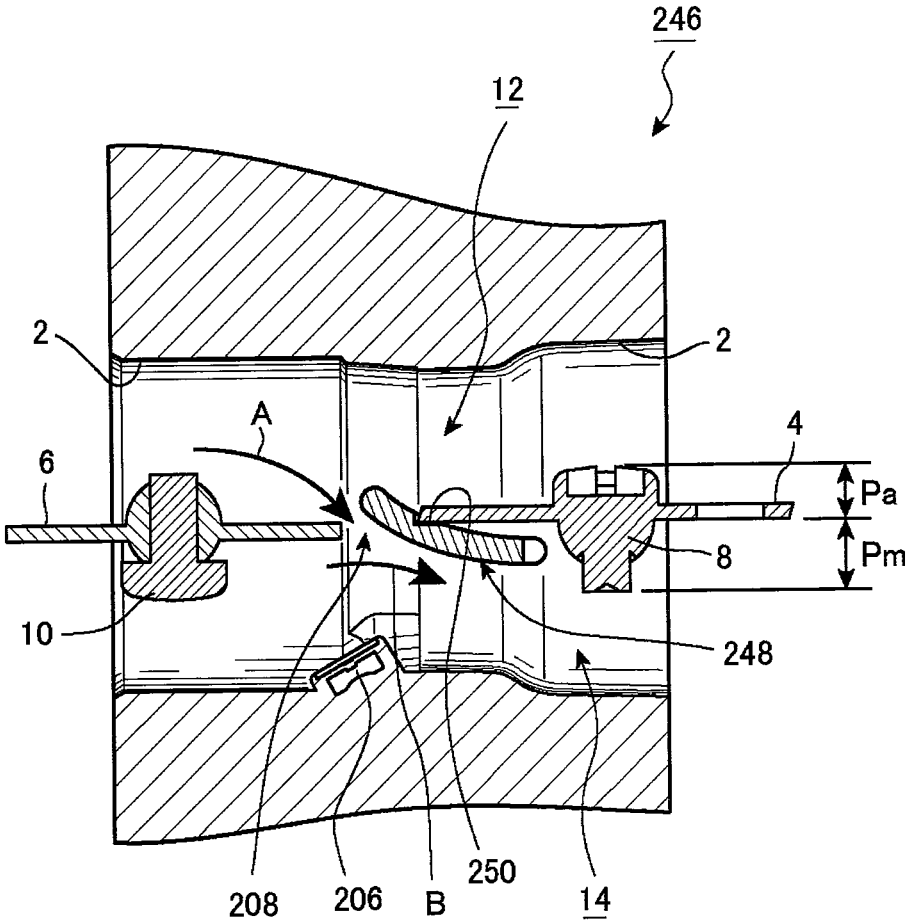
FIG. 39 is a vertical cross-sectional view of a gas passage in a carburetor according to an eighth embodiment.
Figure 40:
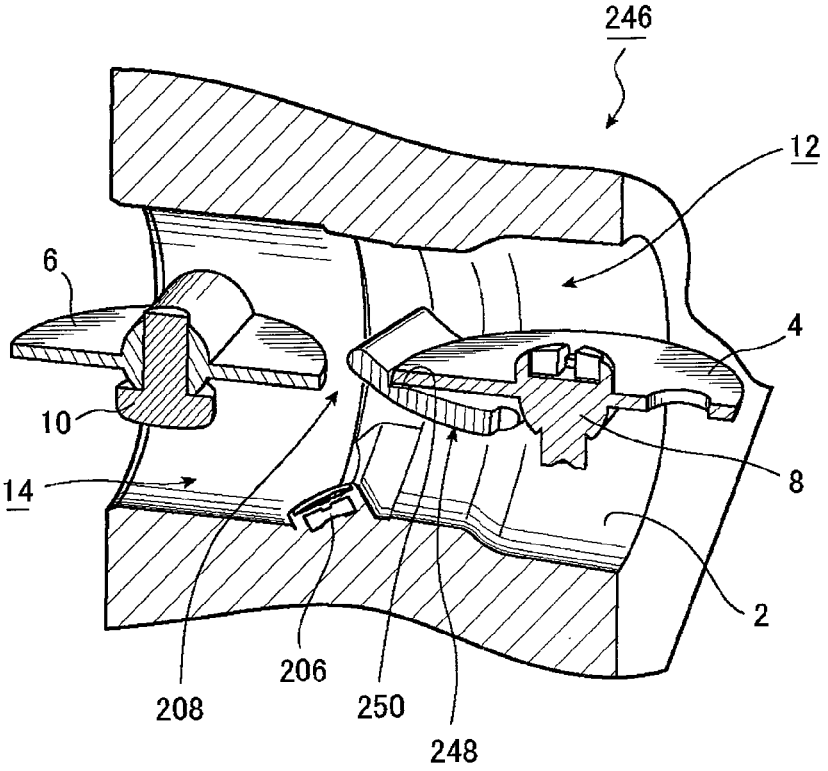
FIG. 40 is a perspective view of the cross-section illustrated in FIG. 39.
Figure 41:
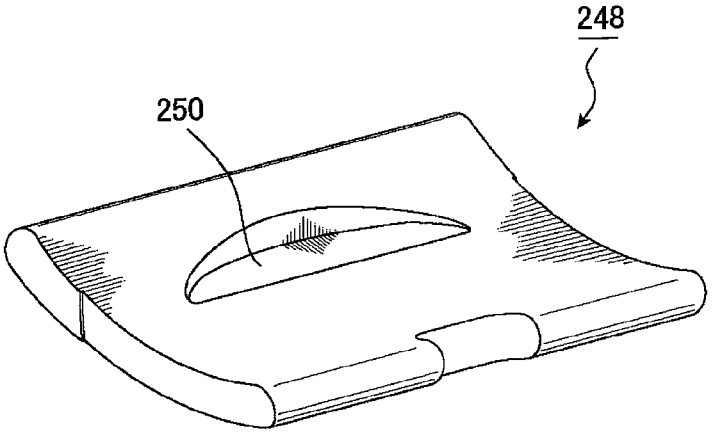
FIG. 41 is a perspective view of an inhibition member included in the carburetor illustrated in FIG. 39.
Figure 42:
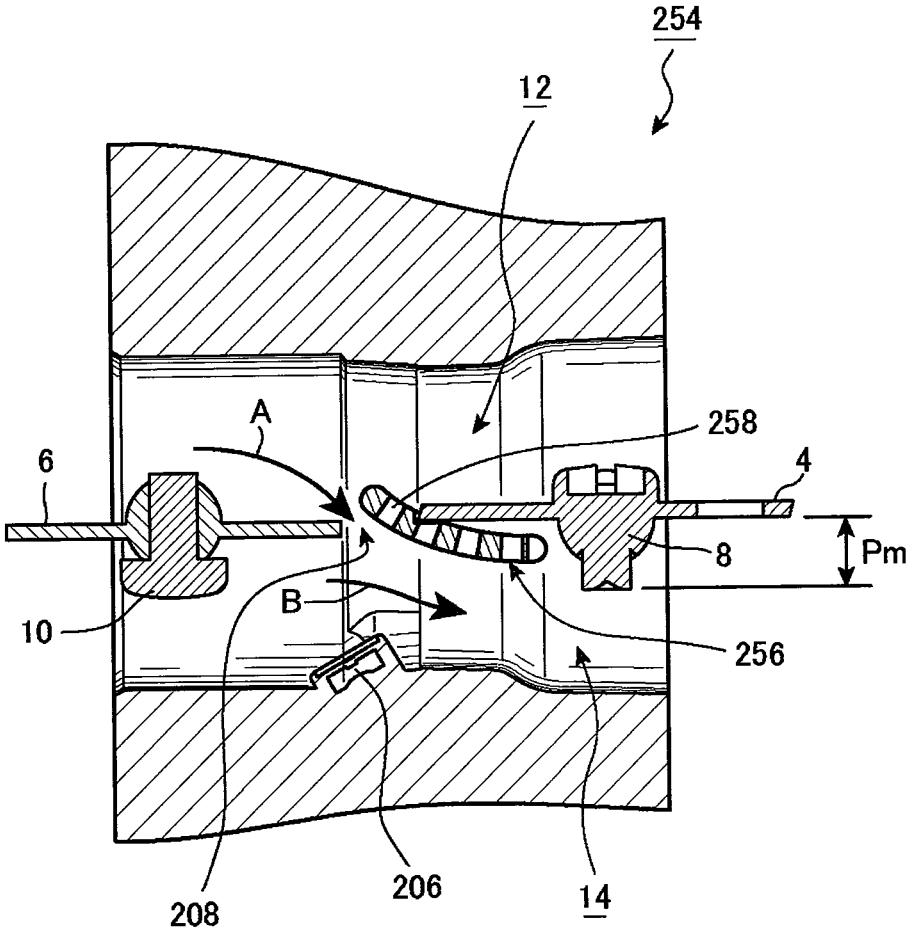
FIG. 42 is a vertical cross-sectional view of a gas passage in a carburetor according to a ninth embodiment.
Figure 43:
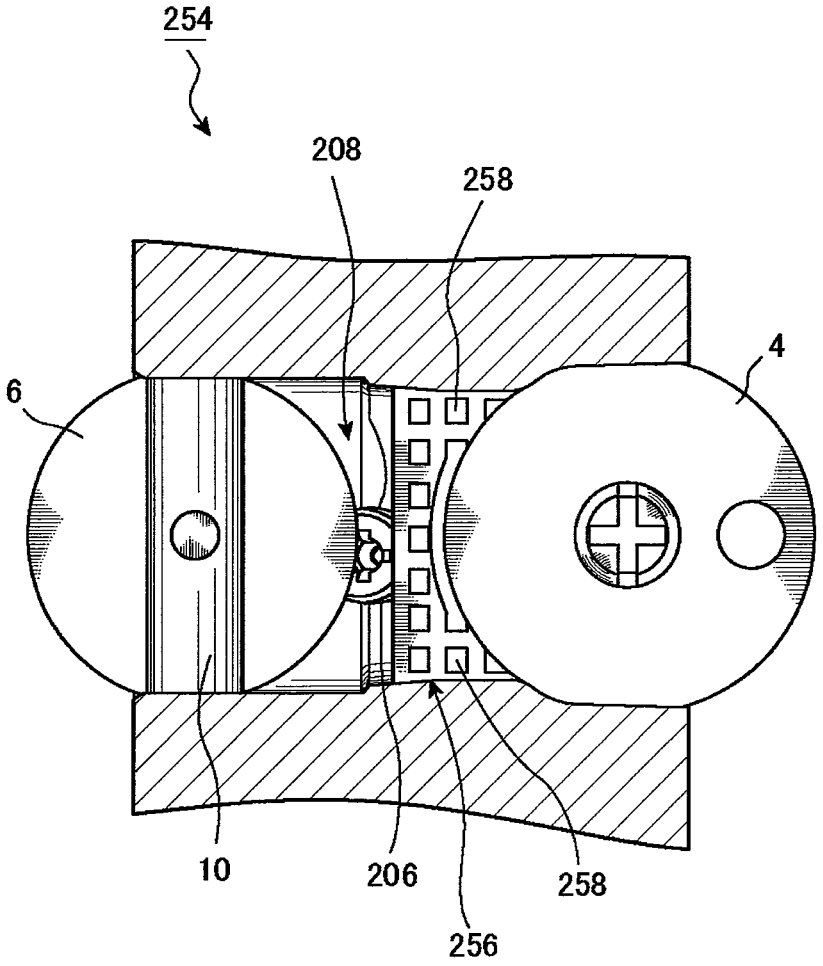
FIG. 43 is a horizontal cross-sectional view of the gas passage in the carburetor according to the ninth embodiment, which is illustrated in FIG. 42.
Figure 44:
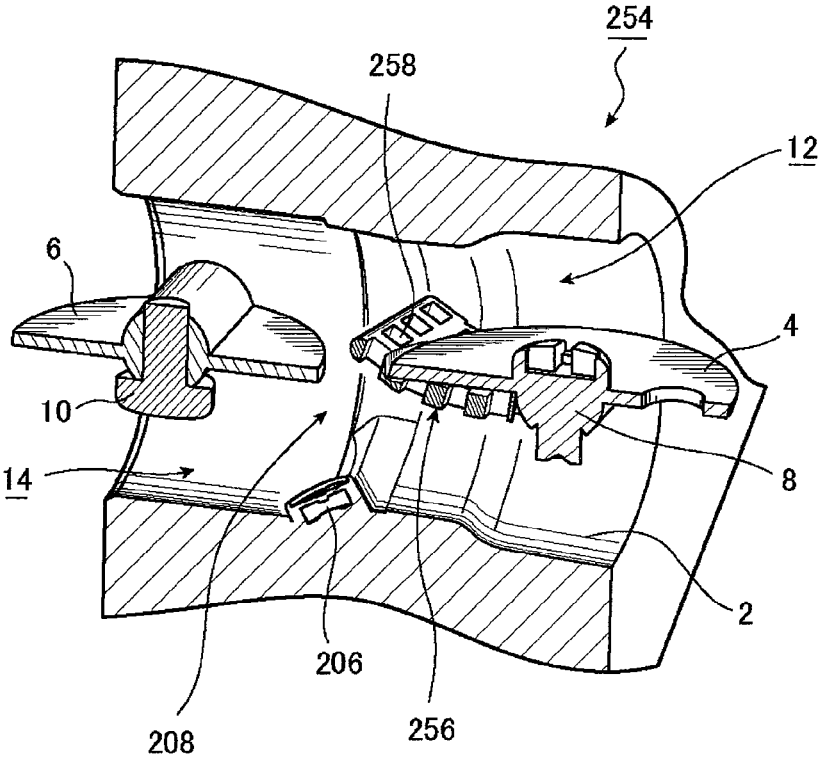
FIG. 44 is a perspective view of the cross-section illustrated in FIG. 42.
Figure 45:
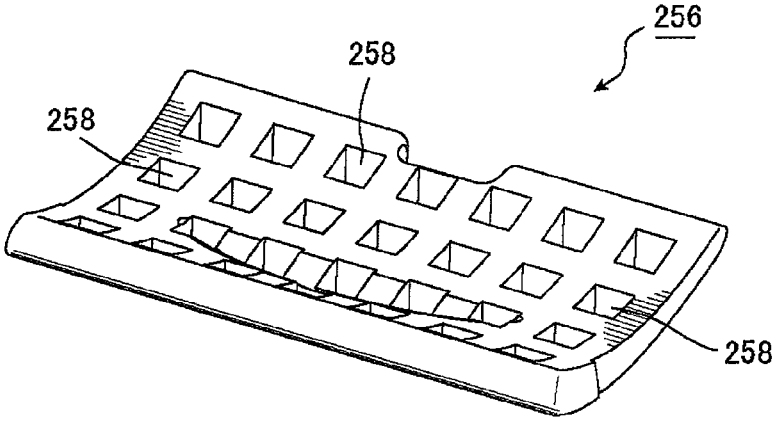
FIG. 45 is a perspective view of an inhibition member included in the carburetor illustrated in FIG. 42.
Figure 46:
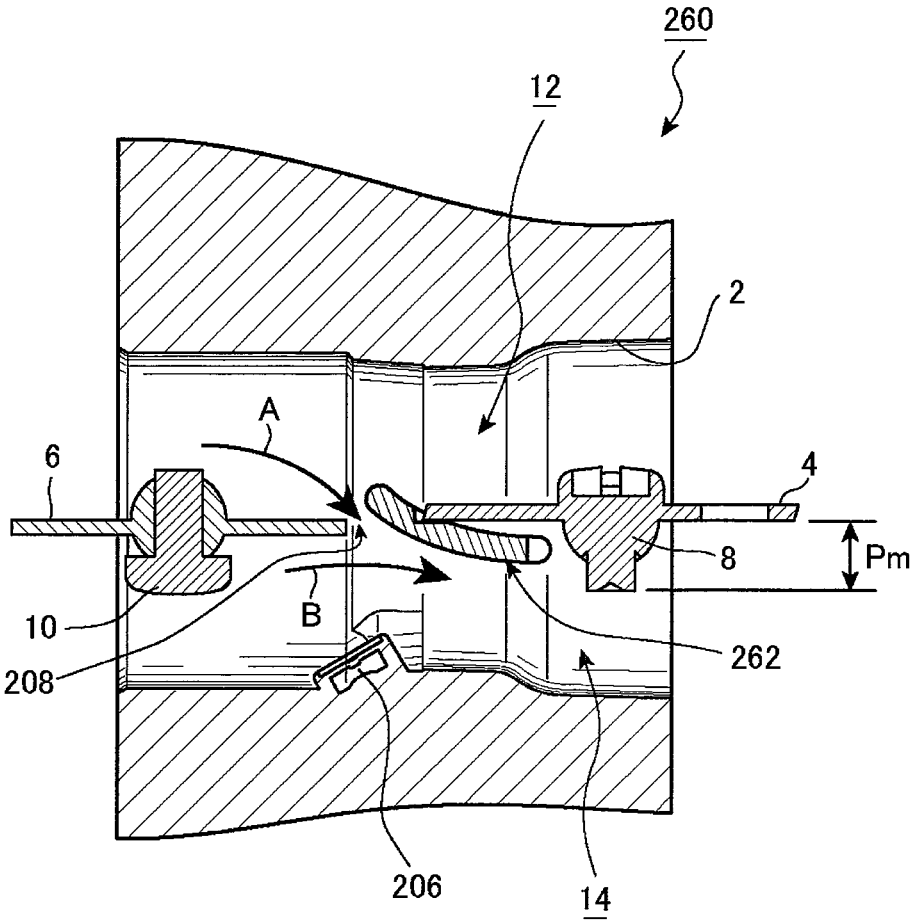
FIG. 46 is a vertical cross-sectional view of a gas passage in a carburetor according to a tenth embodiment.

Eighth Embodiment (FIGS. 39 to 41)

FIGS. 39 to 41 illustrate a carburetor 246 according to an eighth embodiment. An inhibition member 248 included in the carburetor 246 according to the eighth embodiment is placed upstream of a throttle valve 6. Also, the inhibition member 248 is placed in an air-fuel mixture channel 14. More specifically, in the air-fuel mixture channel 14, the inhibition member 248 is placed adjacent to the choke valve 4 in a full-open position.

As can be seen best from FIG. 41, the inhibition member 248 has a rectangular shape in planar view, and has a shape curved in a convex toward the air-fuel mixture channel 14 in side view. In FIG. 41, reference numeral 250 denotes a dent of the inhibition member 248. The dent 250 receives a downstream end portion of the choke valve 4 in a full-open position. A downstream end portion of the inhibition member 248 enters an opening 208. Preferably, the downstream end portion of the inhibition member 248 may project to the air channel 12. Reference sign Pa in FIG. 39 indicates a range in which a rotation shaft 8 of the choke valve projects from the choke valve 4 to the air channel 12. Also, reference sign Pm indicates a range in which the rotation shaft 8 of the choke valve projects from the choke valve 4 to the air-fuel mixture channel 14. It should be understood that the inhibition member 248 is preferably positioned within the above projection ranges Pa and Pm.

Referring to FIG. 39, the inhibition member 248 included in the eighth embodiment can guide a blow-back flow B of the air-fuel mixture in the air-fuel mixture channel 14 to the inside, that is, a center portion of the air-fuel mixture channel 14. Also, the inhibition member 248 can guide a part of a blow-back flow A of air in the air channel 12 to the air-fuel mixture channel 14 through the opening 208. Therefore, the inhibition member 248 included in the eighth embodiment guides the blow-back flow A of air to the air-fuel mixture channel 14 through the opening 208 and guides the blow-back flow B of the air-fuel mixture in the air-fuel mixture channel 14 to the inside, that is, the center portion of the air-fuel mixture channel 14, enabling inhibition of entry of the air-fuel mixture into the air channel 12. Note that it should be understood that the inhibition member 248 may be placed adjacent to the throttle valve 6 in the air channel 12.

Ninth Embodiment (FIGS. 42 to 45)

FIGS. 42 to 45 illustrate a carburetor 254 according to a ninth embodiment. An inhibition member 256 included in the carburetor 254 according to the ninth embodiment is an alteration of the inhibition member 248 included in the eighth embodiment described above.

The inhibition member 256 includes a plurality of windows or holes 258, for example, in an entire area thereof. An outer contour of the inhibition member 256 including the plurality of windows or holes 258 enables a blow-back flow B of the air-fuel mixture in the air-fuel mixture channel 14 to the inside of the air-fuel mixture channel 14.

Figure 1:
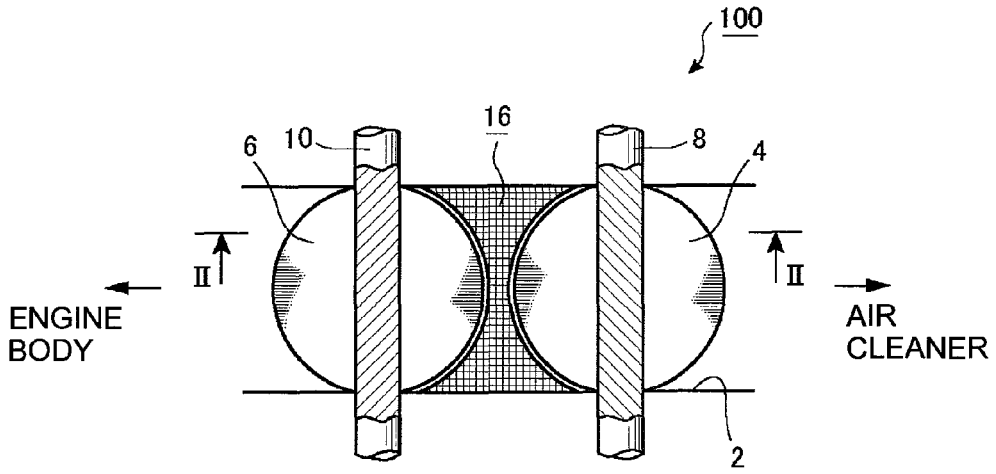
FIG. 1 is a plan view of a carburetor, which is an example to which the present invention has been applied.
Figure 2:
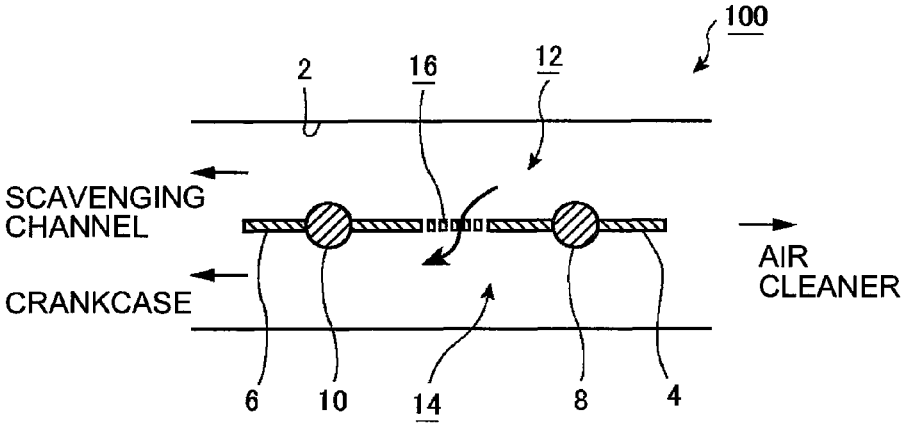
FIG. 2 is a cross-sectional view along line II-II in FIG. 1.
Figure 3:
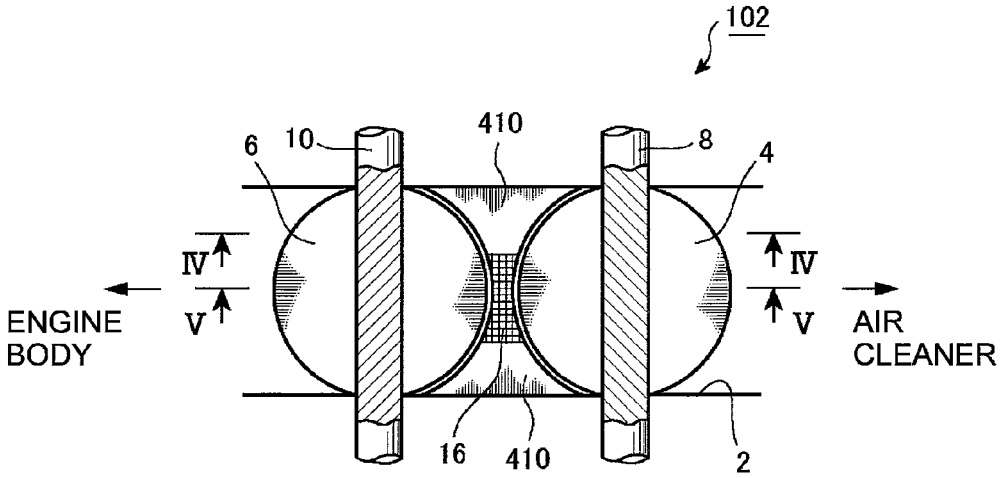
FIG. 3 is a plan view of a carburetor, which is a second example to which the present invention has been applied.
Figure 4:
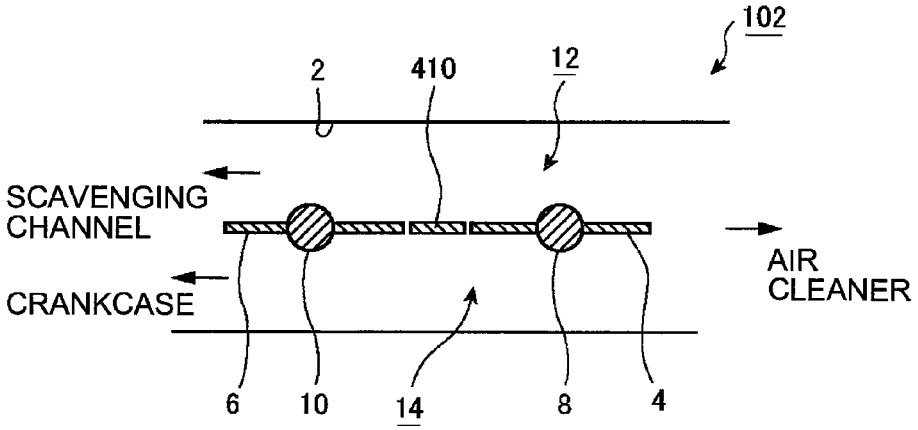
FIG. 4 is a cross-sectional view along line IV-IV in FIG. 3.
Figure 5:
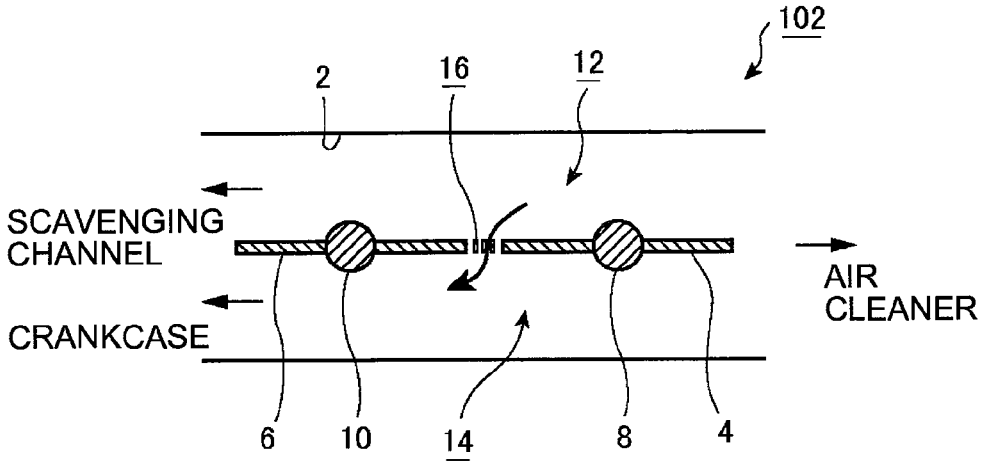
FIG. 5 is a cross-sectional view along line V-V in FIG. 3.
Figure 6:
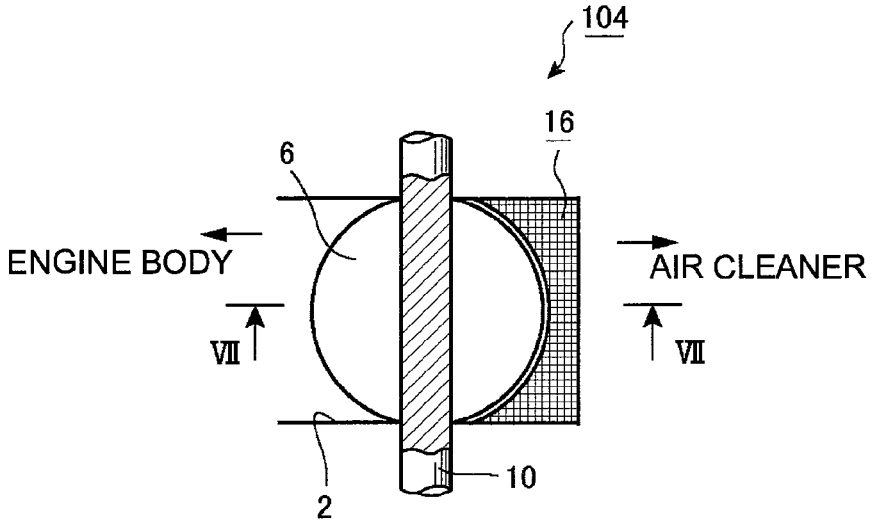
FIG. 6 is a plan view of a carburetor, which is a third example to which the present invention has been applied.
Figure 7:
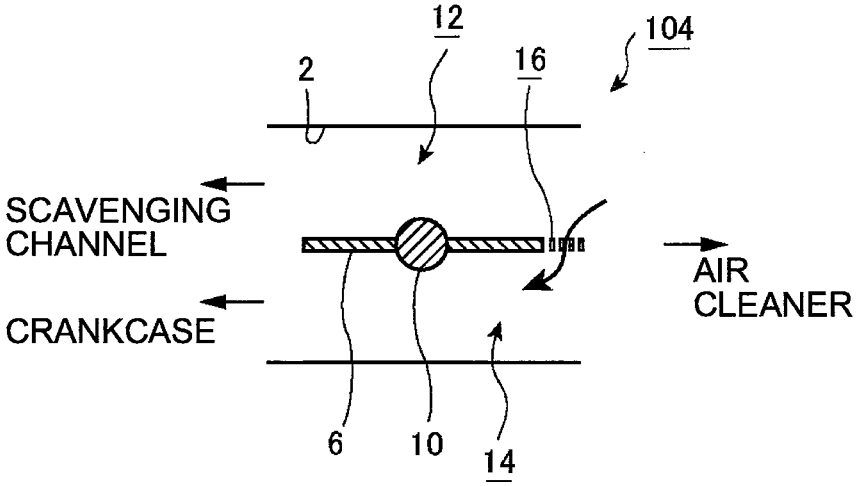
FIG. 7 is a cross-sectional view along line VII-VII in FIG. 6.
Figure 8:
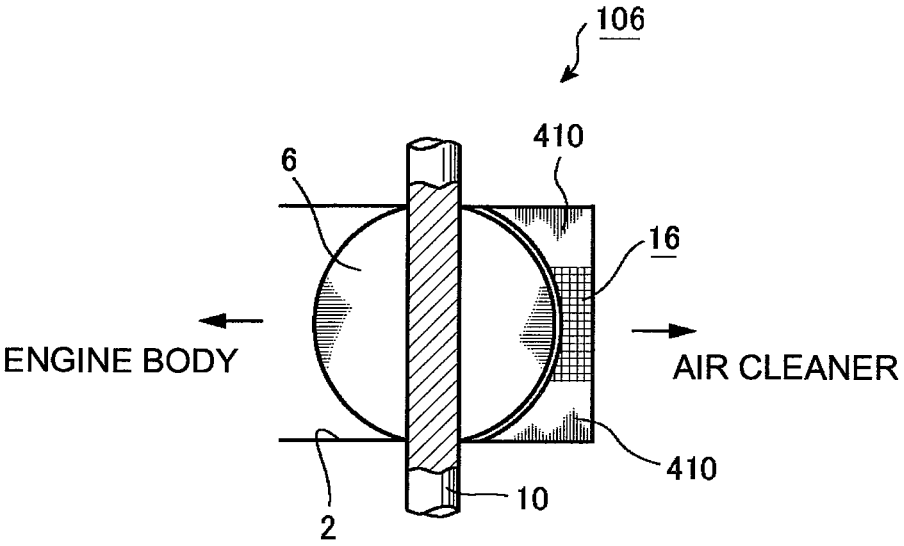
FIG. 8 is a plan view of a carburetor, which is a fourth example to which the present invention has been applied.

Note that a mesh member, which has been described with reference to FIG. 1, etc., may be attached to each of all or part of the plurality of windows or holes 258 of the inhibition member 256, depending on the size of the windows or holes 258. If the windows or holes 258 are relatively small, it is favorable that no mesh member be provided. If the window or holes 258 are relatively large, a mesh member may be provided or no mesh member may be provided.

Tenth Embodiment (FIGS. 46 to 49)

FIGS. 46 to 49 illustrate a carburetor 260 according to a tenth embodiment. An inhibition member 262 included in the carburetor 260 according to the tenth embodiment is an alteration of the inhibition member 256 included in the ninth embodiment described above.

Figure 47:
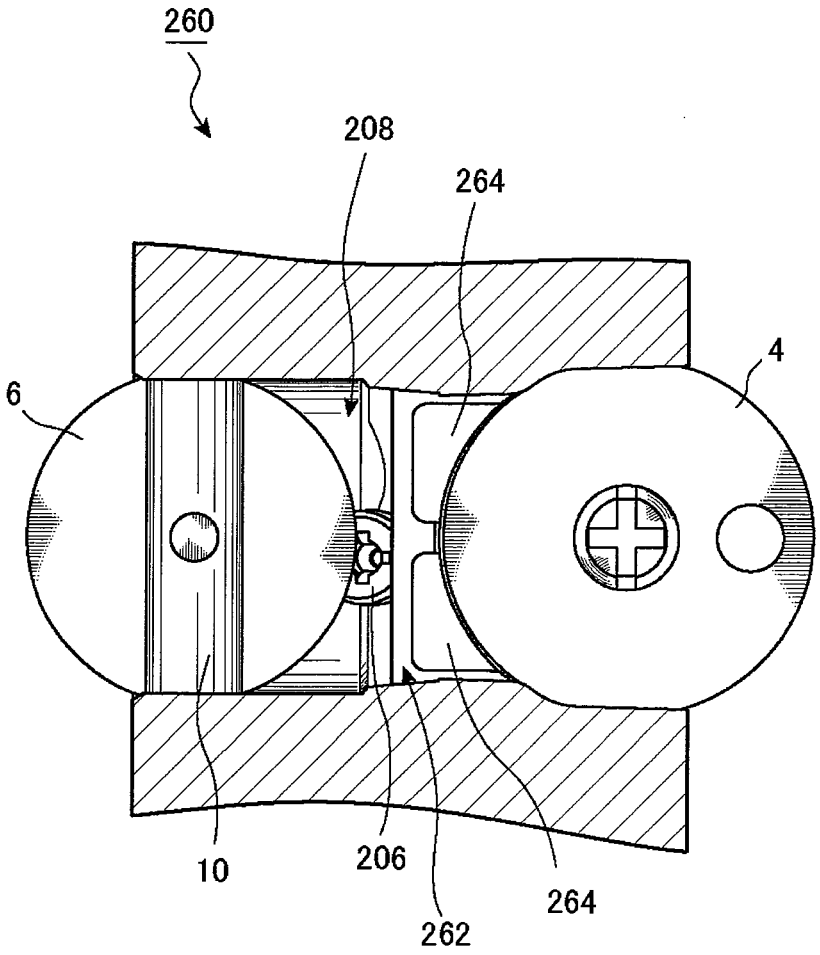
FIG. 47 is a horizontal cross-sectional view of a gas passage in a carburetor according to the tenth embodiment, which is illustrated in FIG. 46.
Figure 48:
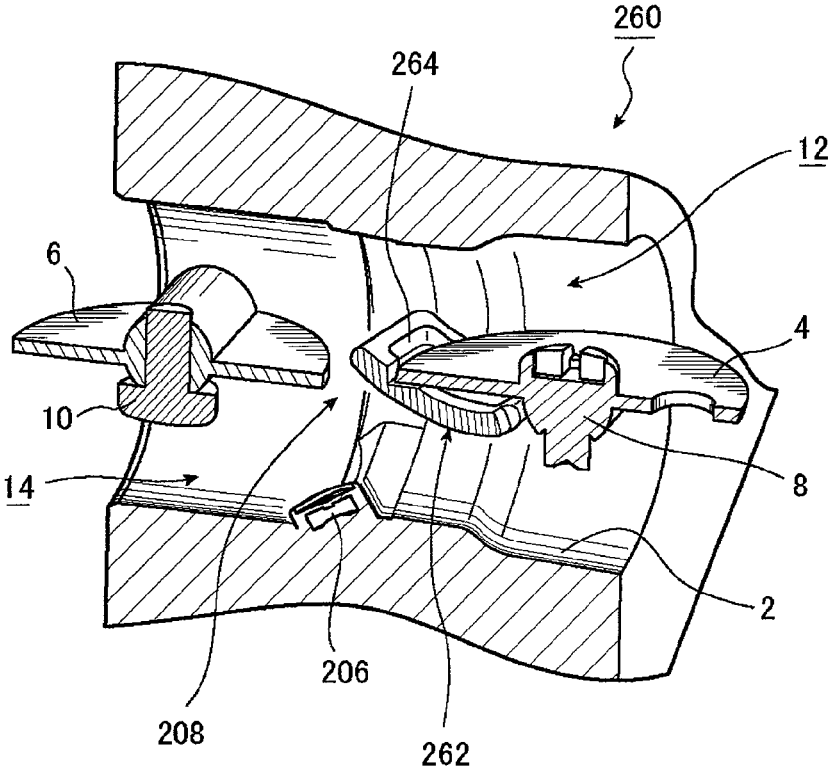
FIG. 48 is a perspective view of the cross-section illustrated in FIG. 46.
Figure 49:
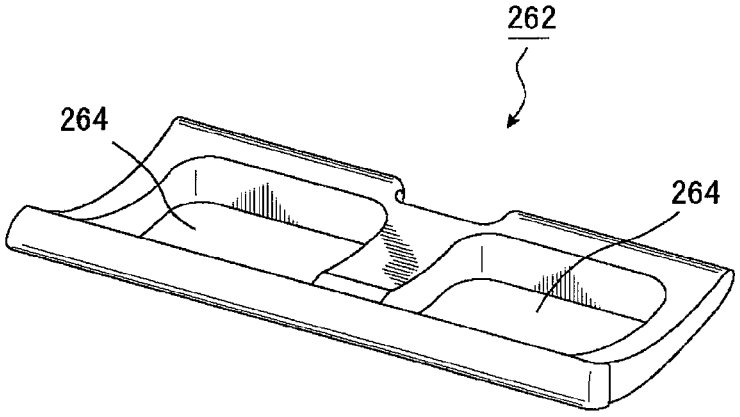
FIG. 49 is a perspective view of an inhibition member included in the carburetor illustrated in FIG. 46.

The inhibition member 262 included in the tenth embodiment includes two large windows 264 arranged side by side in an axis direction of a rotation shaft 8 of a choke valve 4 (FIGS. 47 and 49). A mesh member, which has been described with reference to FIG. 1, etc., is preferably attached to each of the windows 264 of the inhibition member 262. In the figures, illustration of the mesh member is omitted.

Figure 50:
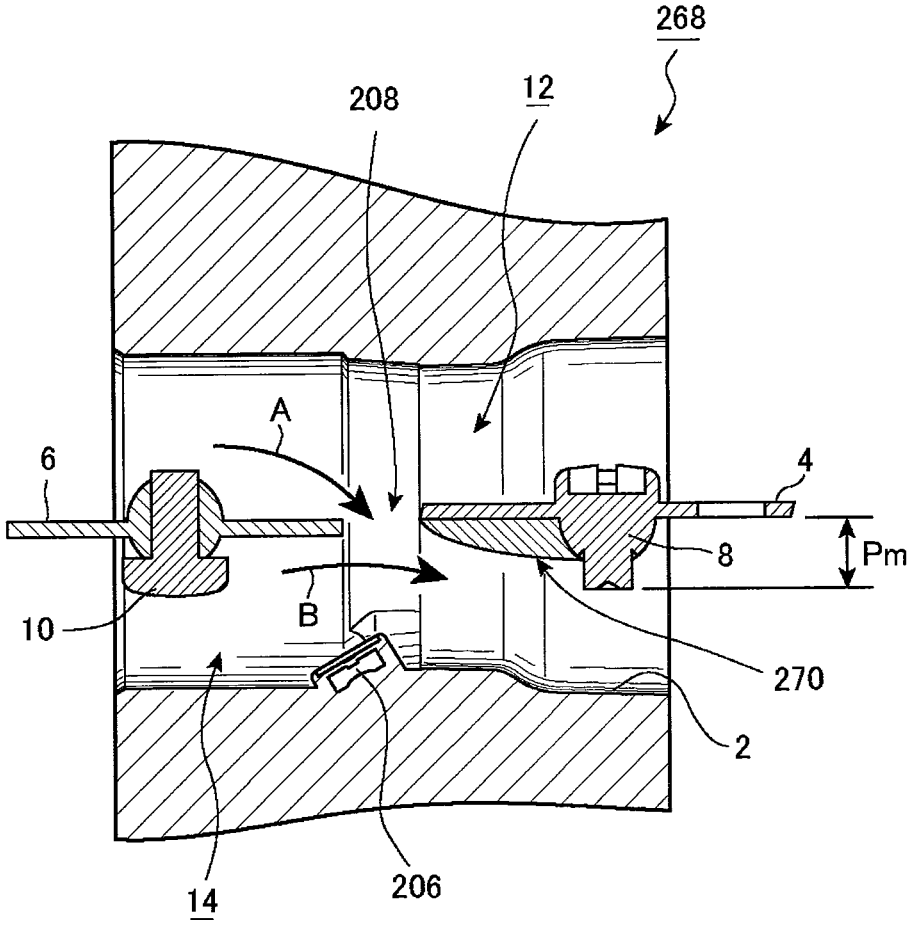
FIG. 50 is a vertical cross-sectional view of a gas passage in a carburetor according to an eleventh embodiment.
Figure 51:
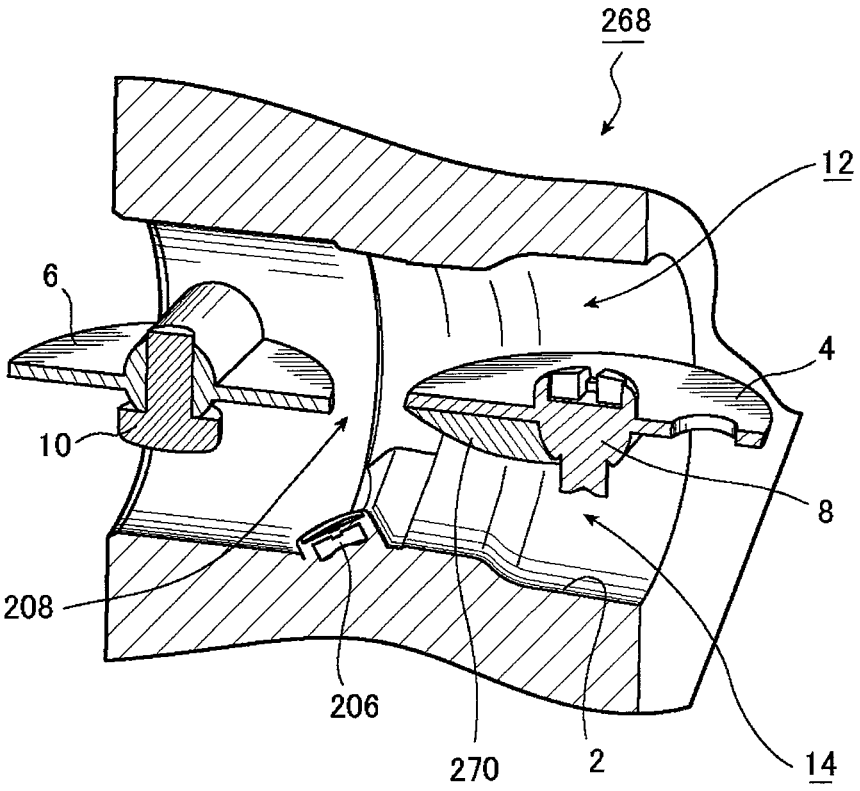
FIG. 51 is a perspective view of the cross-section illustrated in FIG. 50.

Eleventh Embodiment (FIGS. 50 and 51)

FIGS. 50 and 51 illustrate a carburetor 268 according to an eleventh embodiment. An inhibition member 270 included in the carburetor 268 according to the eleventh embodiment is attached to a choke valve 4 positioned upstream of a throttle valve 6. More specifically, the inhibition member 270 is disposed on a part on the downstream side of a surface of the choke valve 4, the surface defining an air-fuel mixture channel 14 when the choke valve 4 is fully opened. The inhibition member 270 extends along a halfway of a circumference of the choke valve 4, that is, a semicircular outer contour on the downstream side of the choke valve 4 relative to a rotation shaft 8.

Referring to FIGS. 50 and 51, the inhibition member 270 has a wing-like shape in cross-section. As can be seen well from the figures, the inhibition member 270 has a cross-sectional shape curved in a convex toward the air-fuel mixture channel 14. A thickness of the inhibition member 270 is preferably designed within a range Pm in which the rotation shaft 8 projects from the choke valve 4. The inhibition member 270 guides a blow-back flow B of the air-fuel mixture in the air-fuel mixture channel 14 to the inside, that is, a center portion of the air-fuel mixture channel 14 (FIG. 50). The blow-back flow B of the air-fuel mixture draws a blow-back flow A of air in the air channel 12 in through an opening 208. The drawing of the air through the opening 208 enables inhibition of entry of the air-fuel mixture into the air channel 12 through the opening 208.

As an alteration, the inhibition member 270 may be attached to the throttle valve 6. It should be understood that the inhibition member 270 may be attached to each of the choke valve 4 and the throttle valve 6. In this alteration, the inhibition member 270 may be disposed on a surface of the throttle valve 6, the surface defining the air channel 12 when the throttle valve 6 is fully opened.

Figure 52:
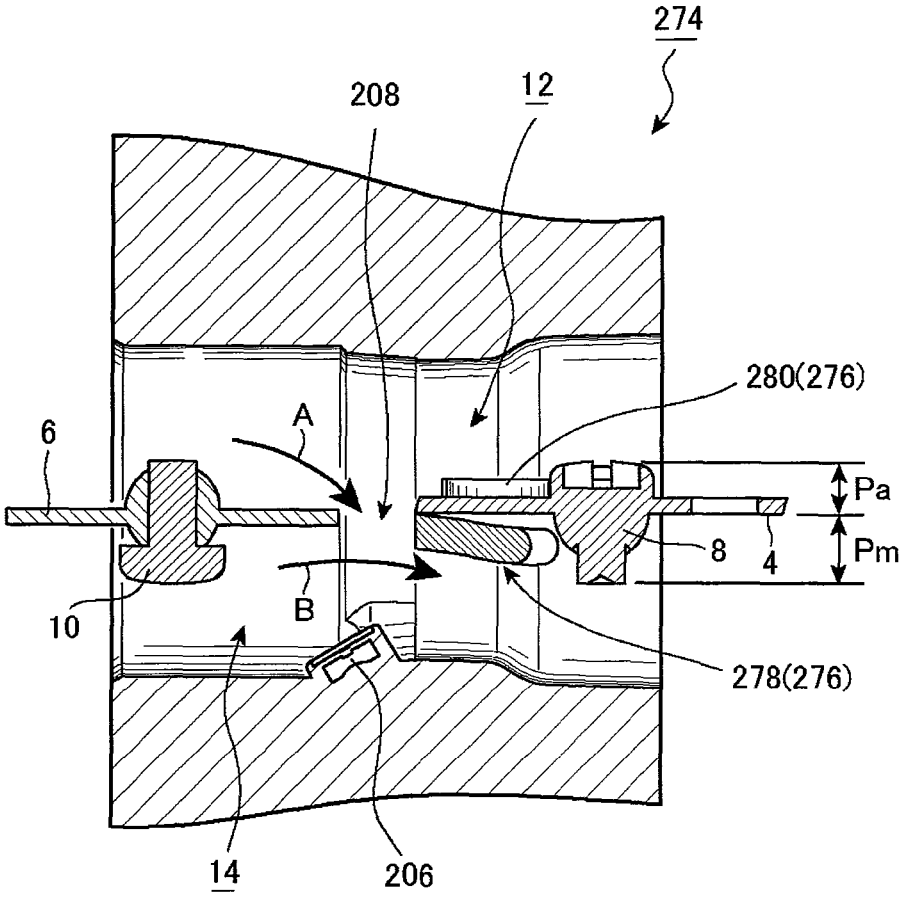
FIG. 52 is a vertical cross-sectional view of a gas passage in a carburetor according to a twelfth embodiment.
Figure 53:
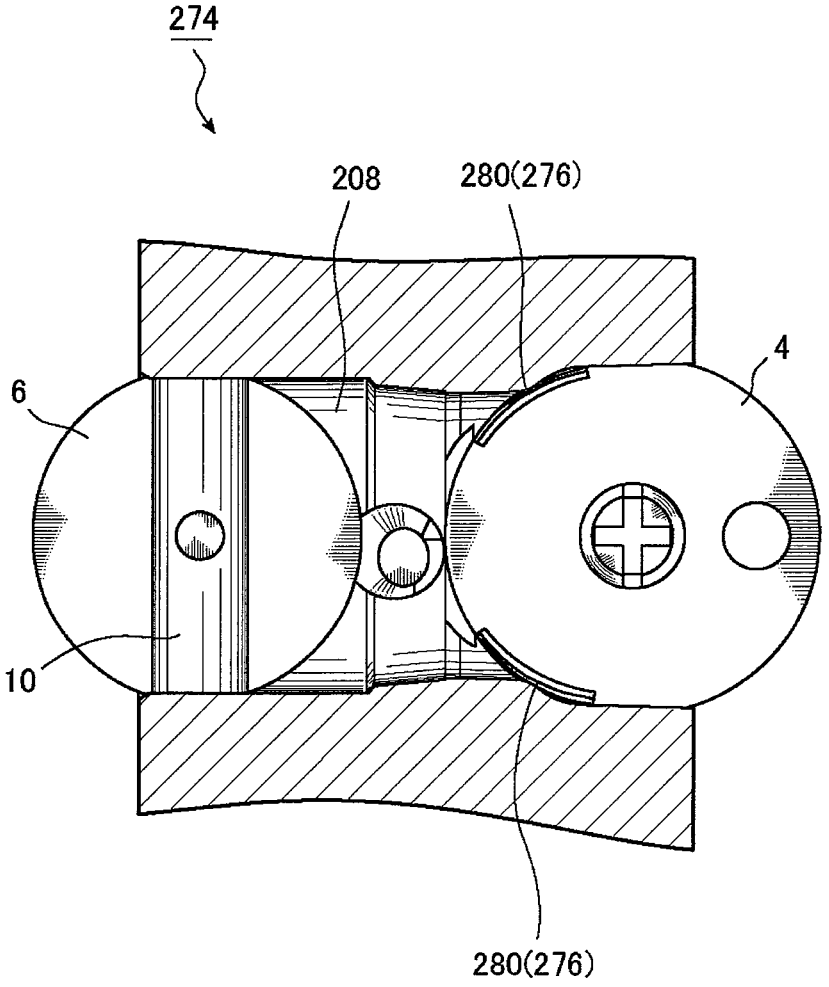
FIG. 53 is a horizontal cross-sectional view of the gas passage in the carburetor according to the twelfth embodiment, which is illustrated in FIG. 52.
Figure 54:
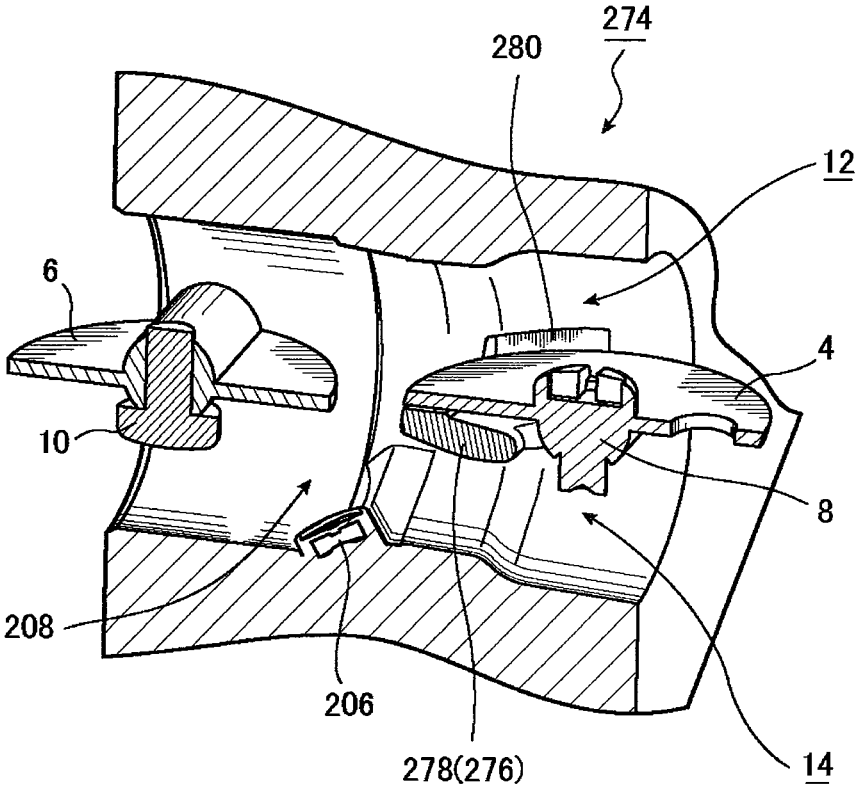
FIG. 54 is a perspective view of the cross-section illustrated in FIG. 52.

Twelfth Embodiment (FIGS. 52 to 54)

FIGS. 52 to 54 illustrate a carburetor 274 according to a twelfth embodiment. An inhibition member 276 included in the carburetor 274 according to the twelfth embodiment includes a single guide member 278 and two deflection members 280. The guide member 278 is disposed adjacent to a surface on the air-fuel mixture channel 14-side of a choke valve 4. The deflection members 280 are disposed on the left and right sides of a surface of the choke valve 4, the surface forming an air channel 12, and are attached to the downstream side of a rotation shaft 8 of the choke valve 4.

It is favorable that the guide member 278 be positioned within a range Pm in which the rotation shaft 8 projects from the choke valve 4 in a full-open position toward the air-fuel mixture channel 14. The guide member 278 is preferably positioned over a half on the downstream side of a circumference of the choke valve 4.

The deflection member 280 has a shape extending so as to curve along an outer circumferential edge on the downstream side of the choke valve 4 in planar view. It is favorable that the deflection members 280 be positioned within a range of an area Pa in which the rotation shaft 8 projects from the choke valve 4 in a full-open position toward the air channel 12 (FIG. 52). As an alteration, the deflection members 280 may extend successively over the half on the downstream side of the circumference of the choke valve 4 relative to the rotation shaft 8.

Referring to FIG. 52, the inhibition member 276 according to the twelfth embodiment enables a blow-back flow B of an air-fuel mixture to be guided to the inside of the air-fuel mixture channel 14 by the guide member 278 positioned in the air-fuel mixture channel 14. The guiding enables inhibition of entry of the air-fuel mixture into the air channel 12 through an opening 208. Furthermore, the blow-back flow B of the air-fuel mixture draws a blow-back flow A of air in the air channel 12 through the opening 208. The drawing of the air through the opening 208 enables inhibition of entry of the air-fuel mixture into the air channel 12 through the opening 208.

In addition to the inhibition effect provided by the guide member 278, the deflection members 280 deflect the blow-back flow A of air flowing in the air channel 12. A part of the deflected blow-back flow A of air enters the opening 208. Consequently, the aforementioned inhibition effect can be enhanced.

As an alteration of the twelfth embodiment, the guide members 278 may be provided in the air channel 12. In other words, the guide members 278 may be adjacent to a throttle valve 6 in the air channel 12.

Figure 55:
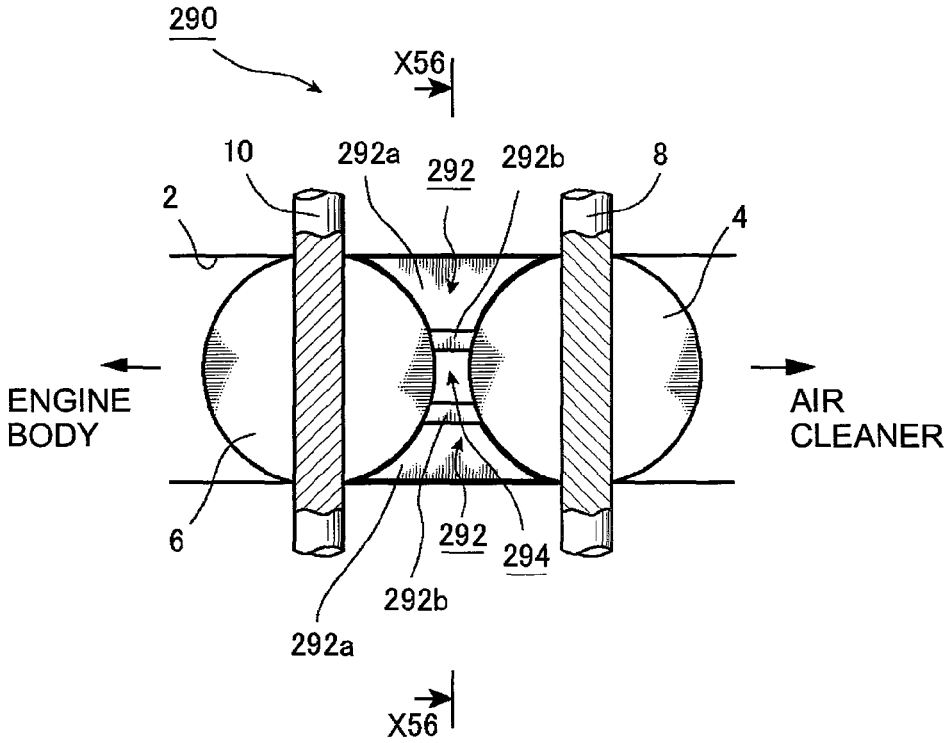
FIG. 55 is a schematic diagram of a gas passage in a carburetor according to a thirteenth embodiment in planar view.
Figure 56:
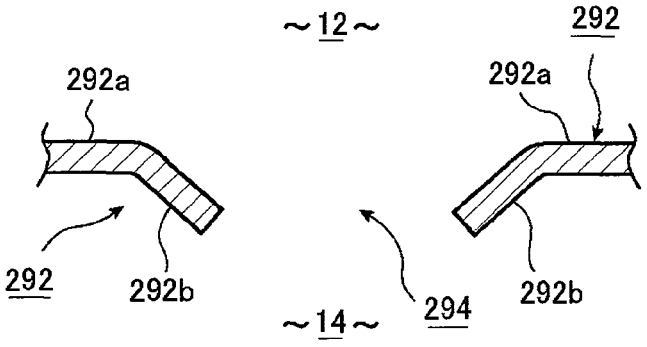
FIG. 56 is a cross-sectional view along line X56-X56 in FIG. 55.

Thirteenth Embodiment (FIGS. 55 and 56)

Figure 63:
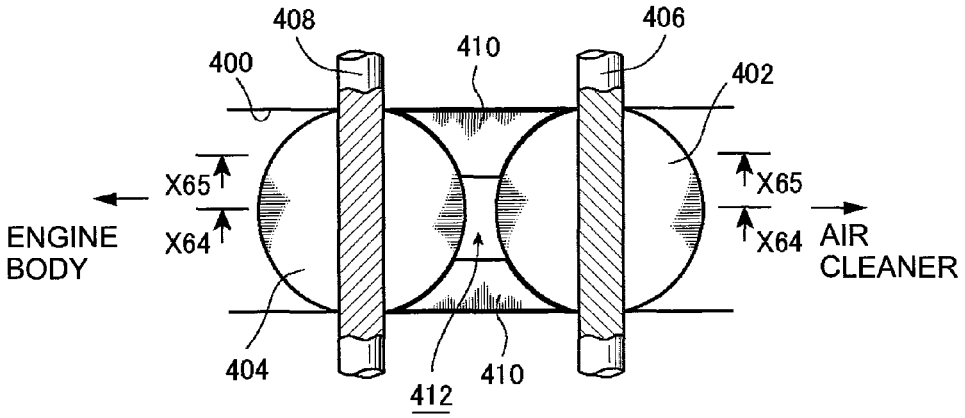
FIG. 63 is a diagram corresponding to FIG. 4 in U.S. Pat. No. 7,494,113 B2, the diagram is provided for describing a conventional art.
Figure 64:
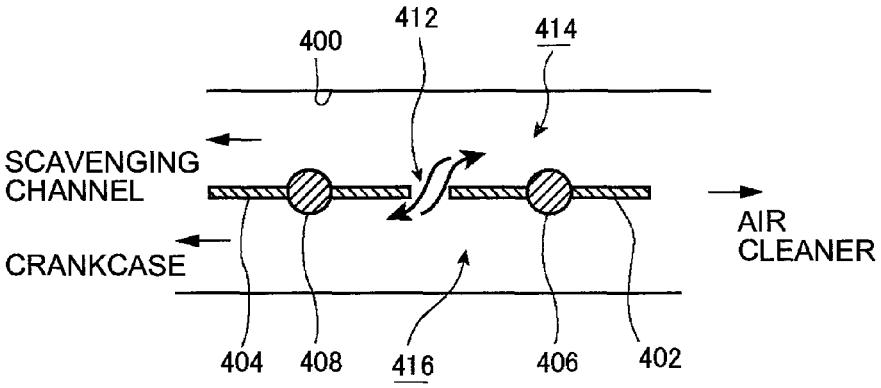
FIG. 64 is a cross-sectional view along X64-X64 in FIG. 63.
Figure 65:
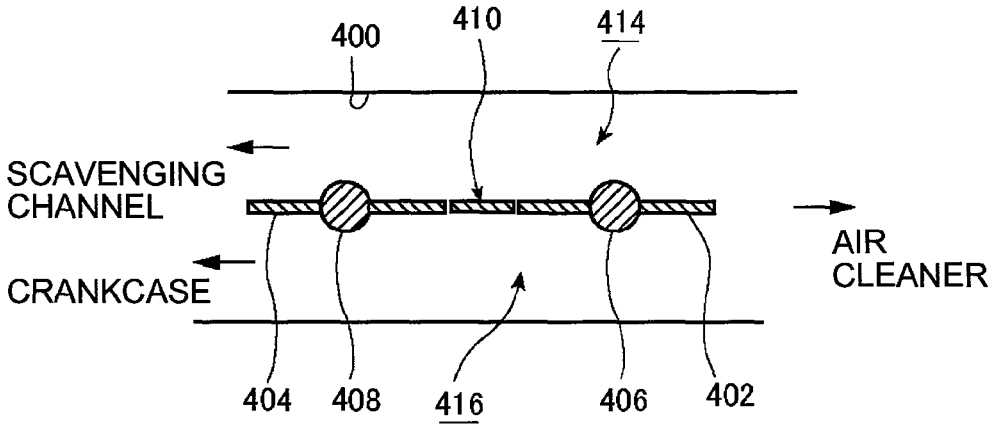
FIG. 65 is a cross-sectional view along X65-X65 in FIG. 63.

FIGS. 55 and 56 illustrate a carburetor 290 according to a thirteenth embodiment. FIG. 55 is a plan view of a gas passage 2 in the carburetor as viewed from the air channel 12-side, and corresponds to FIG. 63 of the conventional art. FIG. 56 is a cross-sectional view along line X56-X56 in FIG. 55. Referring to FIG. 55, a pair of half partition plates 292 is disposed between a choke valve 4 and a throttle valve 6. The pair of half partition plates 292 is placed in a same plane as that of the choke valve 4 in a full-open position and the throttle valve 6 in a full-open position. The choke valve 4 in the full-open position, the throttle valve 6 in the full-open position and the pair of half partition plates 292 define an air channel 12 and an air-fuel mixture channel 14 in the carburetor 290.

An opening 294 is formed between the pair of half partition plates 292, and the opening 294 provides a "communication portion" that brings the air channel 12 and the air-fuel mixture channel 14 into communication with each other. Each of the pair of half partition plates 292 includes a body 292*a* extending between the choke valve 4 and the throttle valve 6, and a first flexed portion 292*b* flexed from an inner end of the body 292*a* toward the air-fuel mixture channel 14-side. The first flexed portions 292*b* function as "inhibition members". In other words, the first flexed portions 292*b* prevent a blow-back flow B in the air-fuel mixture channel 14 from entering the air channel 12.

Figure 57:
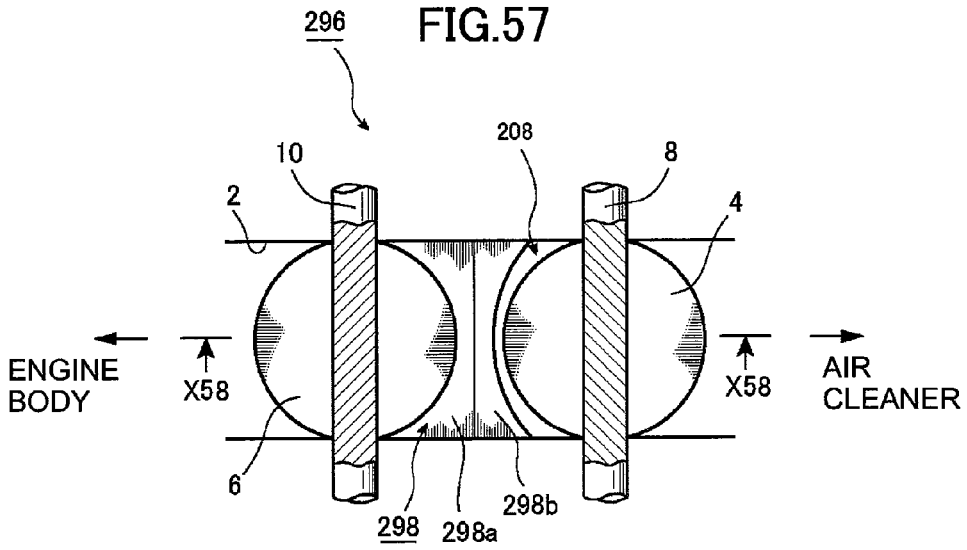
FIG. 57 is a schematic diagram of a gas passage in a carburetor according to a fourteenth embodiment.
Figure 58:
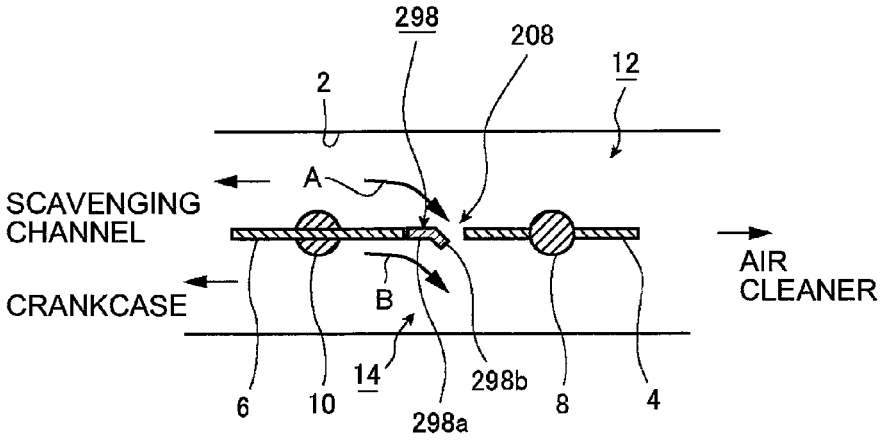
FIG. 58 is a cross-sectional view alone line X58-X58 in FIG. 57.

Fourteenth Embodiment (FIGS. 57 and 58)

FIG. 57 illustrates a carburetor 296 according to a fourteenth embodiment. FIG. 58 is a cross-sectional view along line X58-X58 in FIG. 57. An inhibition member 298 included in the carburetor 296 according to the fourteenth embodiment is placed upstream of and adjacent to a throttle valve 6. The inhibition member 298 includes a flat-plate portion 298*a* positioned between the choke valve 4 in a full-open position and the throttle valve 6 in a full-open position. The flat-plate portion 298*a* partitions a part of an opening 208 between the choke valve 4 in the full-open position and the throttle valve 6 in the full-open position, and has a function that separates an air channel 12 and an air-fuel mixture channel 14 jointly with the valves 4 and 6.

The inhibition member 298 includes a second flexed portion 298*b* flexed from an end on the choke valve 4-side of a flat-plate portion 298*a* to the air-fuel mixture channel 14-side. The second flexed portion 298*b* functions as an "inhibition member". In other words, referring to FIG. 58, a blow-back flow B in the air-fuel mixture channel 14 is deflected by the second flexed portion 298*b* and thereby directed to the inside of the air-fuel mixture channel 14. Also, a blow-back flow A in the air channel 12 is guided toward the opening 208. Consequently, the air-fuel mixture is prevented from entering the air channel 12 through the opening 208.

Figure 59:
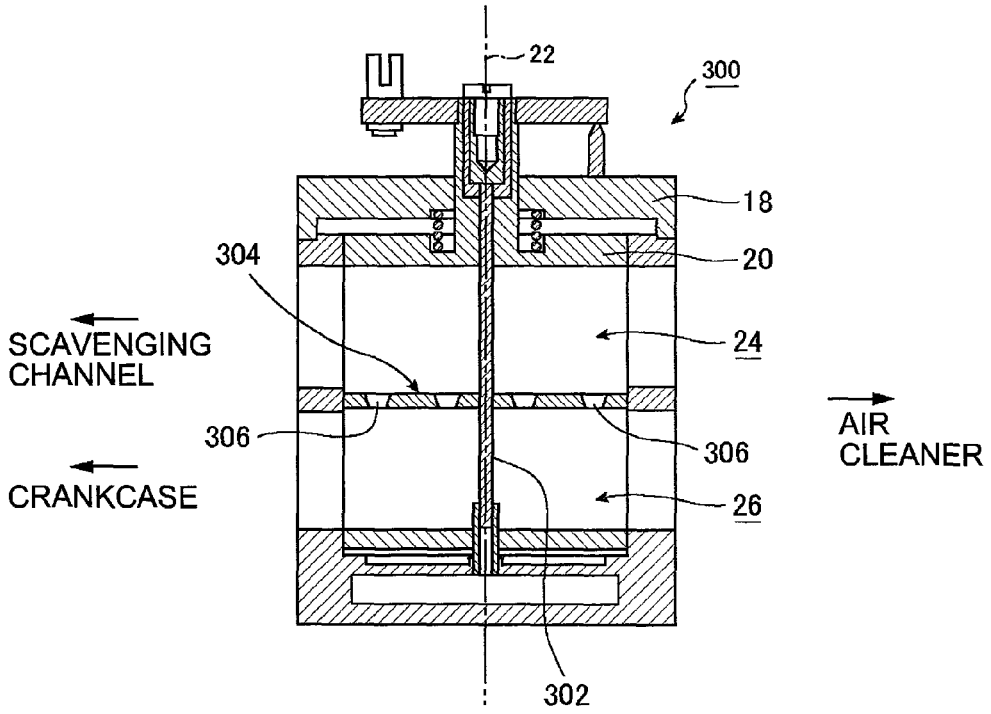
FIG. 59 is a cross-sectional view of a rotary type carburetor according to a fifteenth embodiment, which corresponds to FIG. 9.
Figure 60:
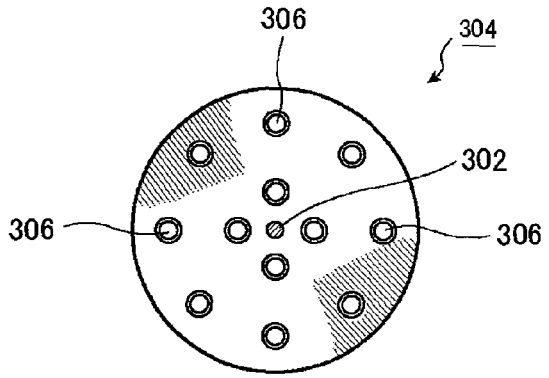
FIG. 60 is a plan view of a disc included in the rotary type carburetor illustrated in FIG. 59.

Fifteenth Embodiment (FIGS. 59 and 60)

Figure 9:
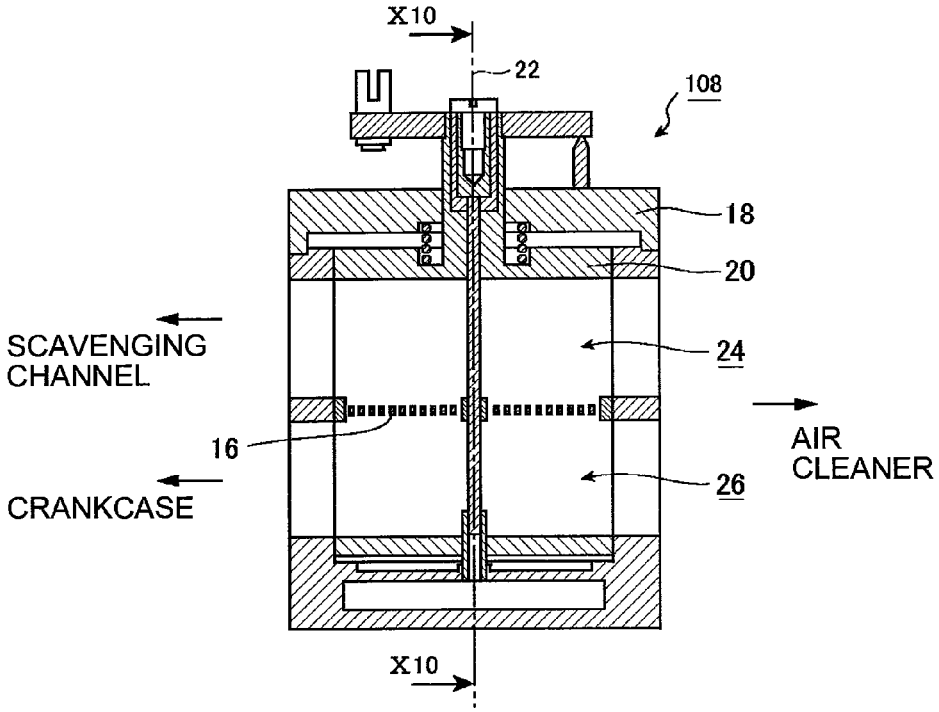
FIG. 9 is a vertical cross-sectional view of a rotary valve to which the present invention has been applied, the view being one cut along an axial line of a gas passage.
Figure 10:
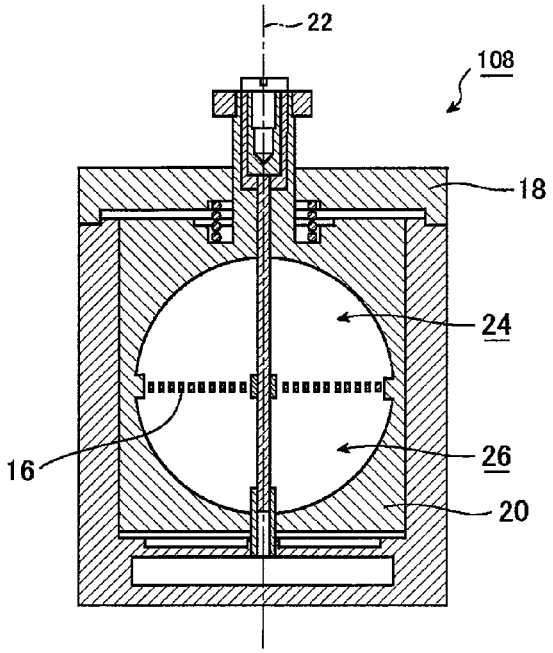
FIG. 10 is a vertical cross-sectional view of the rotary valve illustrated in FIG. 9, the view being one cut along a plane intersecting with the gas passage.
Figure 11:
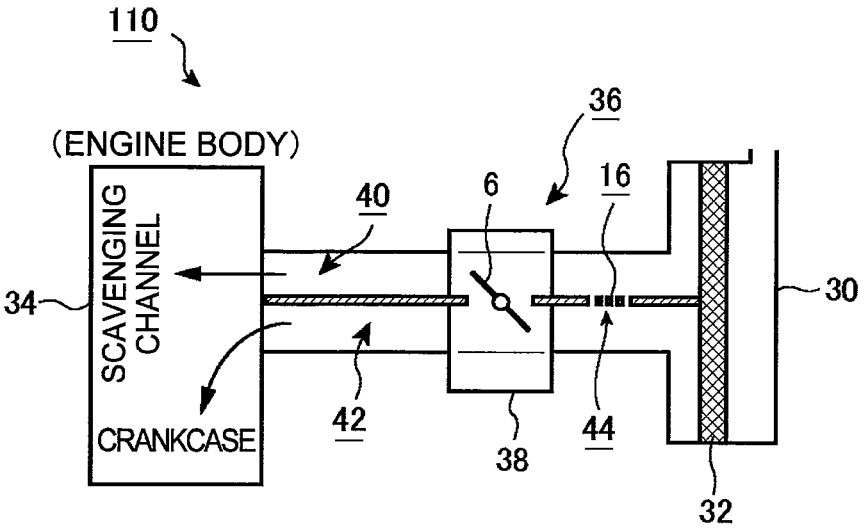
FIG. 11 is a diagram illustrating an example of a two-stroke engine to which the present invention has been applied.
Figure 12:
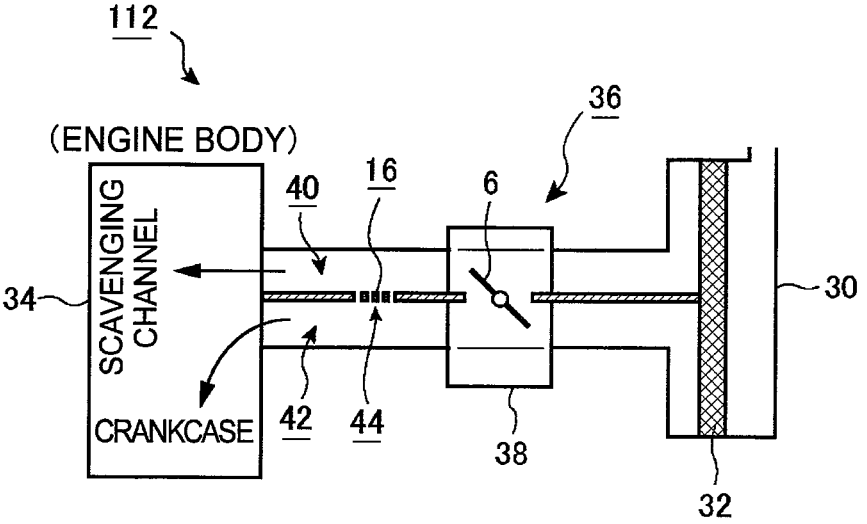
FIG. 12 is a diagram illustrating another example of a two-stroke engine to which the present invention has been applied.
Figure 13:
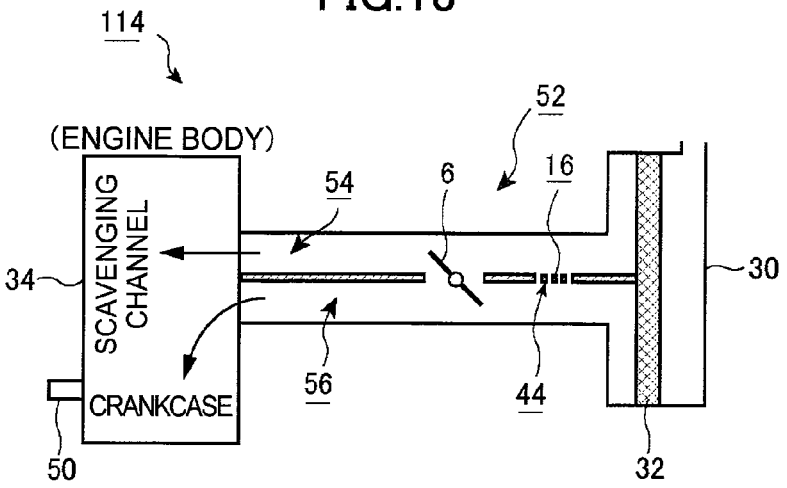
FIG. 13 is a diagram for describing an example to which the present invention has been applied to a two-stroke engine including a fuel injection valve.

A carburetor 300 according to a fifteenth embodiment is a rotary type carburetor. In the description of the carburetor 300 according to the fifteenth embodiment, components that are the same as those included in the rotary type carburetor 108 described above with reference to FIGS. 9 and 10 are provided with reference numerals that are the same as those of the rotary type carburetor 108, and description thereof will be omitted.

Referring to FIG. 59, the rotary type carburetor 300 includes a disc 304 placed around a rotation shaft 302 of a rotating body 20. An air channel 24 and an air-fuel mixture channel 26 are formed by the disc 304.

In the disc 304, a plurality of openings 306 are formed, and each opening 306 has a shape tapered toward the air-fuel mixture channel 26.

Figure 14:
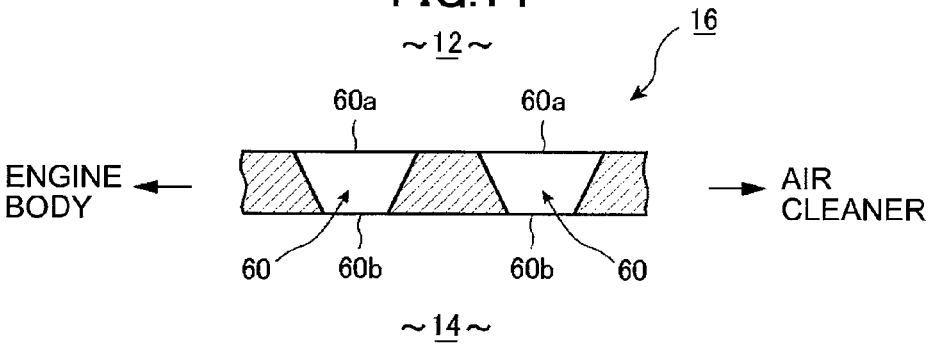
FIG. 14 is a partial cross-sectional view for describing an example in which an inhibition member includes a plate member including a plurality of holes.
Figure 15:
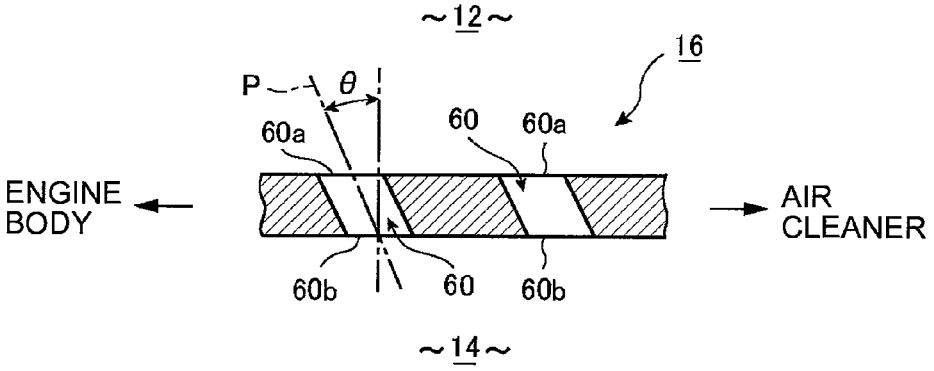
FIG. 15 is a partial cross-sectional view for describing an example in which the plurality of holes illustrated in FIG. 14 are inclined.

As in the example described with reference to FIG. 14, the tapered shape openings 306 inhibit entry of a blow-back flow in the air-fuel mixture channel 26 into the air channel 24. Therefore, the disc 304 including the tapered openings 306 provides an "inhibition member".

Figure 61:
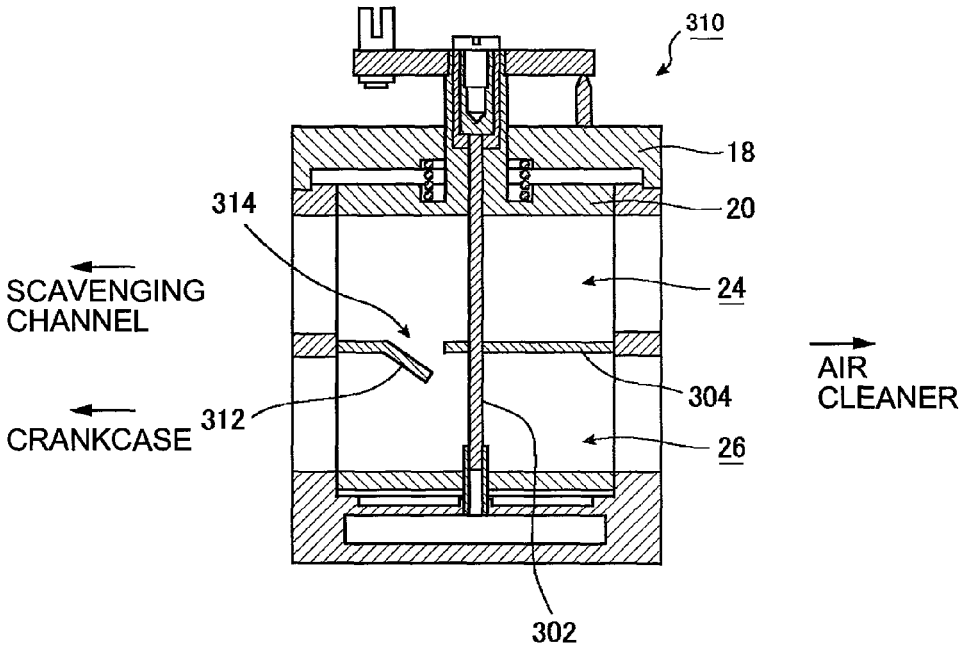
FIG. 61 is a cross-sectional view of a rotary type carburetor according to a sixteenth embodiment, which is an alteration of the carburetor illustrated in FIG. 59.
Figure 62:
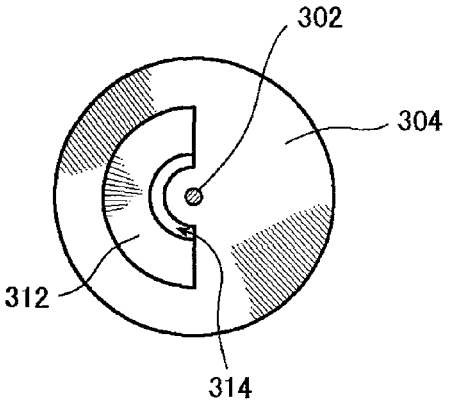
FIG. 62 is a plan view of a disc included in the rotary type carburetor illustrated in FIG. 61.

Sixteenth Embodiment (FIGS. 61 and 62)

A rotary type carburetor 310 according to a sixteenth embodiment is an alteration of the fifteenth embodiment. A disc 304 includes a flexed portion 312 formed by lancing or bending processing instead of the above-described openings 306, and includes an opening 314 formed by the flexed portion 312.

In side view, the flexed portion 312 extends on the air-fuel mixture channel 26-side and the upstream side (air cleaner side). In the embodiment, the flexed portion 312 has a circular-arc shape with a rotation shaft 302 as a center, and in planar view, extends over a substantial half of a circumference of the disc 304; however, the shape of the flexed portion 312 in planar view may be any shape.

As can be understood from the foregoing description, the flexed portion 312 has a function that directs a part of a blow-back flow in an air channel 24 to the opening 314, and this function enables active inhibition of entry of a blow-back flow in the air-fuel mixture channel 26 into the air channel 24 through the opening 314.

REFERENCE SIGNS LIST

100 carburetor according to first example
2 gas passage inside carburetor
4 choke valve
6 throttle valve
8 rotation shaft of choke valve
10 rotation shaft of throttle valve
12 air channel
14 air-fuel mixture channel
16 inhibition member (mesh member)
D diameter of rotation shaft of throttle valve
A blow-back flow of air
B blow-back flow of air-fuel mixture
30 air cleaner
32 filter element
34 engine body
36 intake system
38 carburetor
40 air passage (first passage)
42 air-fuel mixture passage (second passage)
44 communication portion
50 fuel injection valve
52 intake system in fuel injection valve type engine
54 air passage (first passage)
56 second passage
108 rotary type carburetor
114 fuel injection valve type two-stroke engine

What is claimed is:

1. A carburetor forming a part of an intake system to be incorporated in an air leading type two-stroke engine, the carburetor comprising: an air channel providing a part of a first passage that extends from a filter element of an air cleaner to an engine body including a scavenging channel and allows air to be supplied to the scavenging channel; an air-fuel mixture channel providing a part of a second passage that extends extending from the filter element to the engine body and allows an air-fuel mixture to be supplied to a crankcase of the engine body; a throttle valve comprising a butterfly valve and positioned in a gas passage comprised of the air channel and the air-fuel mixture channel; a choke valve comprising a butterfly valve in the gas passage and positioned on the upstream side of the throttle valve; a communication portion between the throttle valve and the choke valve, the communication portion constantly brings the air channel and the air-fuel mixture channel into communication with each other to allow the air in the air channel to flow into the air-fuel mixture channel; and an inhibition member that inhibits entry of a blow-back of the air-fuel mixture passing in the air-fuel mixture channel into the air channel through the communication portion when the throttle valve and the choke valve are respectively in a full-open position, wherein the inhibition member comprises a guide member disposed adjacent to a surface on the air-fuel mixture channel-side of the choke valve to guide a blow-back flow of the air-fuel mixture to the inside of the air-fuel mixture channel and wherein the guide member is positioned within a range in which a rotation shaft of the choke valve projects from the choke valve to the air-fuel mixture channel.

2. The carburetor according to claim 1, wherein the inhibition member further comprises a deflection member disposed on the left and right sides of the surface of the choke valve to deflect a blow-back flow of air flowing in the air channel so that a part of the deflected blow-back flow of air enters the communication portion.

3. The carburetor according to claim 2, wherein the deflection member is positioned within a range in which a rotation shaft of the choke valve projects from the choke valve to the air channel.

4. The carburetor according to claim 2, wherein the deflection member has a shape extending so as to curve along an outer circumferential edge on the downstream side of the choke valve in a plan view.

* * * * *